US005795226A

United States Patent [19]

Yi

[11] Patent Number: 5,795,226

[45] Date of Patent: Aug. 18, 1998

[54] BETTING RACE GAME

[76] Inventor: Chen Yi, 3436 Holyoke Dr., Los Angeles, Calif. 90065

[21] Appl. No.: 691,944

[22] Filed: Aug. 5, 1996

[51] Int. Cl.[6] ..... A63F 9/22

[52] U.S. Cl. ..... 463/22; 463/25; 463/6; 273/243; 273/274; 273/138.1; 273/139

[58] Field of Search ..... 273/236, 237, 273/244, 246, 274, 460, 461, 138.1, 139, 138.2, 146, 145 R, 145 C, 243, 248, DIG. 26; 463/1, 6, 30, 31, 16, 22, 25, 29, 40, 42

[56] References Cited

U.S. PATENT DOCUMENTS

| | | | |
|---|---|---|---|
| D. 151,562 | 10/1948 | Southwell | 273/145 C |
| 171,707 | 1/1876 | Walker | 273/145 C |
| D. 226,111 | 1/1973 | Kahn | 273/145 C |
| 2,739,815 | 3/1956 | Fay | 273/145 C |
| 3,560,127 | 2/1971 | Imperato | 273/146 |
| 3,729,193 | 4/1973 | Labis | 273/86 B |
| 3,963,243 | 6/1976 | Contento | 273/146 |
| 4,060,246 | 11/1977 | Ward | 273/246 |
| 4,373,723 | 2/1983 | Brown et al. | 273/86 B |
| 4,428,580 | 1/1984 | Pasquine | 273/145 C |
| 4,527,798 | 7/1985 | Siekierski et al. | 273/86 R |
| 4,844,462 | 7/1989 | Lubniewski | 273/86 B |
| 4,917,386 | 4/1990 | Tozer | 273/246 |
| 5,186,460 | 2/1993 | Fongeallaz et al. | 273/86 B |
| 5,226,655 | 7/1993 | Rickabaugh | 273/246 |
| 5,411,258 | 5/1995 | Wilson et al. | 273/86 B |

FOREIGN PATENT DOCUMENTS

| | | | |
|---|---|---|---|
| 516160 | 12/1992 | European Pat. Off. | 273/86 B |

*Primary Examiner*—Jessica Harrison
*Assistant Examiner*—Mark A. Sager

[57] ABSTRACT

A device and method of playing a gaming game simulating horse race which however allows betting on a race already started. It comprises a playing surface with a race-course, means for displaying odds and results, means for generating random numbers to determine the progress of a race, means for self-service wagering, probalitity formulas and computer programs to calculate odds determined by the nature of a race and to display them, computer programs to calculate possible payoffs, official results and to display them. Besides, computer programs are provided for an automatic video version of the game.

4 Claims, 6 Drawing Sheets

Tricta Probabilities, Race 5, Winner 7

| j | (7,j,1) | (7,j,2) | (7,j,3) | (7,j,4) | (7,j,5) | (7,j,6) | (7,j,7) | (7,j,8) | (7,j,9) |
|---|---|---|---|---|---|---|---|---|---|
| 1 | ------ | .006750 | .003834 | .001698 | .002650 | .001352 | ------ | .000588 | .000367 |
| 2 | .000353 | ------ | .003834 | .001698 | .002650 | .001352 | ------ | .000588 | .000367 |
| 3 | .000353 | .000178 | ------ | .001698 | .002650 | .001352 | ------ | .000588 | .000367 |
| 4 | .000194 | .000097 | .000049 | ------ | .001612 | .000798 | ------ | .000341 | .000207 |
| 5 | .000424 | .000142 | .000048 | .000015 | ------ | .005293 | ------ | .001795 | .000788 |
| 6 | .000650 | .000218 | .000074 | .000023 | .000011 | ------ | ------ | .002742 | .001207 |
| 7 | ------ | ------ | ------ | ------ | ------ | ------ | ------ | ------ | ------ |
| 8 | .005567 | .003001 | .001649 | .000724 | .000948 | .000452 | ------ | ------ | .005127 |
| 9 | .005567 | .003001 | .001649 | .000724 | .000948 | .000452 | ------ | .000188 | ------ |

FIG.3

NINE DICE $1 (ONE DOLLAR) PAY-OFFS
RACE 3 Regular Bets

| Racer# | 1 | 2 | 3 | 4 | 5 | 6 | 7 | 8 | 9 |
|---|---|---|---|---|---|---|---|---|---|
| WIN | 10.48 | 12.88 | 2.90 | 6.38 | 8.43 | 10.71 | 23.17 | 26.67 | 30.10 |
| PLACE | 5.21 | 6.07 | 1.95 | 2.96 | 3.66 | 4.54 | 8.55 | 10.18 | 11.94 |
| SHOW | 3.68 | 4.28 | 1.64 | 1.85 | 2.22 | 2.76 | 4.73 | 5.78 | 6.92 |

EXACTA

| Racer# | &1 | &2 | &3 | &4 | &5 | &6 | &7 | &8 | &9 |
|---|---|---|---|---|---|---|---|---|---|
| 1& | ------ | 52.1 | 26.1 | 61.5 | 102.9 | 170.7 | 357.8 | 517.8 | 747.2 |
| 2& | 695.1 | ------ | 26.1 | 61.5 | 102.9 | 170.7 | 357.8 | 517.8 | 747.2 |
| 3& | 38.0 | 52.1 | ------ | 8.5 | 13.2 | 20.0 | 42.4 | 56.2 | 72.7 |
| 4& | 67.1 | 93.8 | 48.5 | ------ | 21.4 | 32.8 | 69.5 | 93.1 | 122.1 |
| 5& | 67.1 | 93.8 | 48.5 | 115.0 | ------ | 32.8 | 69.5 | 93.1 | 122.1 |
| 6& | 67.1 | 93.8 | 48.5 | 115.0 | 193.2 | ------ | 69.5 | 93.1 | 122.1 |
| 7& | 124.6 | 179.7 | 98.3 | 235.2 | 398.7 | 667.4 | ------ | 157.1 | 209.8 |
| 8& | 124.6 | 179.7 | 98.3 | 235.2 | 398.7 | 667.4 | 1405.8 | ------ | 209.8 |
| 9& | 124.6 | 179.7 | 98.3 | 235.2 | 398.7 | 667.4 | 1405.8 | 2043.5 | ------ |

34B BET 34D Display WPS/Double 34X Exit

FIG.4A

NINE DICE $1 (ONE DOLLAR) PAY-OFFS
RACE 6 Regular Bets

| Racer# | 1 | 2 | 3 | 4 | 5 | 6 | 7 | 8 | 9 |
|---|---|---|---|---|---|---|---|---|---|
| WIN | 6.07 | 7.90 | 10.00 | 21.09 | 23.98 | 4.12 | 8.78 | 11.12 | 13.73 |
| PLACE | 3.27 | 3.96 | 4.77 | 9.00 | 10.30 | 2.51 | 4.05 | 4.84 | 5.80 |
| SHOW | 2.32 | 2.73 | 3.23 | 5.55 | 6.50 | 2.01 | 2.40 | 2.84 | 3.42 |

DOUBLE

| Racer# | &1 | &2 | &3 | &4 | &5 | &6 | &7 | &8 | &9 |
|---|---|---|---|---|---|---|---|---|---|
| 1& | 30.1 | 40.4 | 52.4 | 111.0 | 127.9 | 145.5 | 36.9 | 48.2 | 61.4 |
| 2& | 39.2 | 52.7 | 68.2 | 144.5 | 166.5 | 189.4 | 48.1 | 62.8 | 80.0 |
| 3& | 49.6 | 66.7 | 86.4 | 182.9 | 210.9 | 239.8 | 60.8 | 79.5 | 101.3 |
| 4& | 104.6 | 140.6 | 182.2 | 385.7 | 444.6 | 505.7 | 128.3 | 167.5 | 213.5 |
| 5& | 119.0 | 159.9 | 207.2 | 438.7 | 505.7 | 575.2 | 145.9 | 190.6 | 242.8 |
| 6& | 20.4 | 27.5 | 35.6 | 75.3 | 86.8 | 98.8 | 25.1 | 32.7 | 41.7 |
| 7& | 43.6 | 58.5 | 75.9 | 160.6 | 185.1 | 210.6 | 53.4 | 69.8 | 88.9 |
| 8& | 55.2 | 74.1 | 96.1 | 203.4 | 234.5 | 266.7 | 67.7 | 88.4 | 112.6 |
| 9& | 68.1 | 91.5 | 118.6 | 251.1 | 289.5 | 329.3 | 83.5 | 109.1 | 139.0 |

35B BET 35E Display WPS/Exacta 35X Exit

FIG.4B

Official Results $1 Pay-offs
Race 4

Regular Bets

| | Win | Place | Show | Exacta | Double | Tricta | Triple |
|---|---|---|---|---|---|---|---|
| 1 | 8.40 | 4.41 | 3.11 | 1-6 | 3-1 | 1-6-8 | 2-3-1 |
| 6 | | 3.55 | 2.23 | 88.9 | 24.4 | 359.8 | 70.9 |
| 8 | | | 4.41 | | | | |

Second Chance

| | Win | Place | Show | Exacta | Double | Tricta | Triple |
|---|---|---|---|---|---|---|---|
| 1 | 3.73 | 2.23 | 1.68 | 1-6 | 3-1 | 1-6-8 | 2-3-1 |
| 6 | | 2.30 | 1.77 | 14.5 | 14.7 | 38.8 | 39.8 |
| 8 | | | 2.84 | | | | |

Last Chance

| | Win | Place | Show | Exacta | Double | Tricta | Triple |
|---|---|---|---|---|---|---|---|
| 1 | 1.75 | 1.32 | 1.18 | 1-6 | 3-1 | 1-6-8 | 2-3-1 |
| 6 | | 2.82 | 1.78 | 5.5 | 9.8 | 12.1 | 33.3 |
| 8 | | | 1.82 | | | | |

REMINDER: Play the subsequent race OR pending bets will be cancelled/refunded

BETTING RACE GAME

BACKGROUND OF THE INVENTION

CROSS REFERENCES TO RELATED APPLICATIONS

Prior application Ser. No. 08/512,310, filed Aug. 8, 1995, now abandoned, contained similar subject matter.

1. Field of the Invention

The present invention is in the field of games, more specifically, methods and devices for gaming games.

2. The Prior Art

As far as betting method is concerned, the game at any race track is a prior art. However, at a race track, no betting is allowed on a race already started.

As far as device is concerned, any racing game using chance devices is a prior art. However, none of the known ones uses a dice box similar to the one presented here. Besides, none of them uses probability formulas and computer programs to calculate odds and payoffs.

U.S. Pat. No. 171,707 discloses a dice box consisting of two flat disks connected by a series of vertical rods.

U.S. Pat. Nos. 2,739,815 and 4,428,580 each disclose a transparent hollow body with rectangular compartments.

U.S. Pat. Des. Nos. 151,562 and 226,111 both disclose a cylindrical containers pivotedly mounted on a stand, where the former's rotation axis is the axis of the cylinder while the latter's perpendicular to the axis of the cylinder.

U.S. Pat. No. 3,560,127 discloses a game board with betting zones and a race-course with removable starting gate. Five dice with faces representing eight horses are used to determine the progress of racing.

U.S. Pat. No. 3,729,193 discloses an electronic racing game using a pluraity of motor driven units along a track which combines a random factor with manually actuated means for establishing odds between the racing units.

U.S. Pat. No. 3,963,243 discloses a table-type horse racing game employing dice to advance the game pieces along lanes of a board race track where players may lose their jockeys, saddles or bridles.

U.S. Pat. No. 4,060,246 has a play panel marked with indicia defining a number of score columns for eleven horses. A pair of dice are rolled to obtain eleven numbers from two to twelve, representing eleven horses, and a finish number which is the lowest common multiple of the numbers 1,2,3,4,5 and 6 representing ways in which the eleven horse numbers can be rolled by the dice.

U.S. Pat. No. 4,373,723 discloses an amusement equipment including means for controlling the movement of a plurality of objects and means for selecting which of the objects shall win and player stations to receive control information via a data transmitter and connection system.

U.S. Pat. No. 4,527,798 discloses an gaming machine comprising a random number generator and a memory to control a race which is visually displayed on a computer display.

U.S. Pat. No. 4,844,462 discloses an electronic racing game apparatus employing a micro-processor which controls a plurality of incandescent lamps.

U.S. Pat. No. 4,917,386 discloses a game board with racing lanes and playing pieces. Dice are used for determining the advancement of playing pieces, while indicia on the board determines the probability of advancing the playing piece.

U.S. Pat. No. 5,186,460 discloses a computer controlled racing game providing a display of contestants who move in response to chance factors determined by the computer and strategical inputs suppled to the computer by the players.

U.S. Pat. No. 5,226,655 discloses a playing surface with concentric tracks and an infield. The infield is used for placing bets. Dice and chance cards are used for determining the advancement of position markers.

U.S. Pat. No. 5,411,258 discloses an interactive video horse race game comprising data storage and retrieval means. Players will bet an a pre-recorded actual race.

European Pat. No. 516,160 discloses a simulated visual display system for arcade game device which includes a circuit for providing positions of the simulated images, a circuit for providing a background image and a circuit for selectively outputting those images.

As mentioned by Lubniewski in U.S. Pat. No. 4,844,462, all three of U.S. Pat. Nos. 3,729,193, 4,373,723 and 4,527,798 show devices which are relatively complicated, difficult to construct and extremely expensive.

In all patents named above where complicated probabilities are involved the following problem remains to be clarified: what is the exact probability of a bet and how are pay-offs calculated? Besides, players can never be sure that the outcomes are free from manipulations like at Roulette or Keno.

As one can see from the above, no combinations of known methods and devices are in a position to provide features of my invention disclosed below which is free from all problems and disadvantages mentioned above and always provides fair outcomes like Roulette.

OBJECTS OF THE INVENTION

It is an object of the invention to provide a betting race game without life animals but more exciting than at a race track due to allowing bets on a race already in progress. Those so-called Second Chance and Last Chance bets not only sound attractive, but also actually offer means to offset pending bets.

Another object of the invention provides a betting game taking advantage of today's computer technology. In a game using several dice, depending on millions of possible outcomes per roll there are billions possible charts of odds or payoffs. But only one of them is needed each time. A 486 personal computer can deliver the right one in a few seconds which was impossible for IBM 360 in 1977 when the first computer program for calculating the odds was written and tested.

A more specific object of the invention provides a transparent cylindrical dice box with a revolving partition structure housing nine dice, one in each compartment. The box can be shaken and whirled by hands and set free to roll.

Yet another important object of the invention provides a game of nine races with nine racers under nine slightly different conditions which are either shown on the playing surface or easy to remember. The numbers of advancement spaces from start to finish are not the same for all racers as shown on the playing surface. Although all dice, each representing one racer, are rolled simultaneously, racers move one after the other with the one carrying the race number first.

Furthermore, it is an object of the invention to provide a betting race game satisfying the following two conditions: 1. The majority of odds vary in a range from two to one to a hundred to one. But there are a few very low ones and some over ten thousand to one. 2. The length of racing time is neither too short nor too long such as three to five rolls of dice.

There is also an object aiming at those who interested in automatic machines, namely, to provide an automatic video game with a computer timer randomization to determine the progress of a race.

Besides computers, the invention takes advantage known techniques for providing hand-held printers, screen activated machines and a software called database wagering system, a kind of DBMS (database management system).

SUMMARY OF THE INVENTION

The invention provides a playing surface.

The surface has six betting zones in which there are numbered rectangular spaces for placing bets.

Any placed bet will be removed by a dealer in exchange for a betting ticket issued by a hand-held printer connected to a mainframe computer equipped with database wagering system to manage all bets.

The invention also enables players to use screen activated self-service wagering machines.

The surface has a race-course for placing numbered racer markers to indicate the progress of a race. Racer markers can be moved by hands or by a motor-driven operation. Techniques for implementing such operation are well-known.

The surface has two sections for computer displaying possible payoffs and official results.

The surface has an area to roll a dice box or to place a chance device or random number generator.

The invention provides a transparent cylindrical dice box.

The Box has a revolving partition structure forming nine compartments. There is one die in each compartment. There is a metal weight confined in the partition structure. The weight provides sufficient moment of inertia for the partition structure to revolve when the box is whirled by hands. The weight is also to provide sufficient force of gravity to hold the partition structure horizontal when the box comes to a standstill.

The invention provides a method of playing a betting game of nine races simulating horse racing.

Bets can be made anytime of a race before the third roll of dice. Types of bets are known as Win, Place, Show, Exacta, Double etc. in the racing world. However, they will be classified as Regular, Second Chance and Last Chance depending respectively on if a bet is made before the first, second or third roll of the dice. Before the start of a race all nine racers, represented by numbered markers, are placed on the starting space. After a roll of dice, every racer will move as many spaces as indicated by its representing die. The racer carrying the race number, referred to as starter, moves first. He will be followed by the racer of next higher number, and so on. After Racer 9 comes Racer 1. There are fourteen spaces to advance for Racers 1, 2 and 3, fifteen spaces for Racers 4, 5 and 6, sixteen spaces for Racers 7, 8 and 9. A race ends when three racers finish. Every race needs at least three rolls of dice. The numbers of adveancement spaces are so chosen that 3 rolls of dice is minimal, but only 15% races need a fifth roll. The chance of requiring a sixth roll of dice is one out of 1696. The chance of requiring a seventh roll is one out of 10 million.

The invention shows how to derive probability formulas determined by the nature of each race.

The invention provides computer programs to calculate odds based on probability formulas.

The invention provides computer programs to display possible payoffs and official results.

All possible payoffs of Regular bets will be displayed before the first roll of dice, that of Second Chance before the second roll and that of Last Chance before the third roll. Official Results will be displayed after the end of every race.

Besides, the invention provides all computer programs needed to move the game from a playing surface to an automatic video machine as well as to a computer with keyboard and monitor. The race-course together with every advancement of racers will be displayed where the number of advancement spaces is determined by a computer timer randomization. Positions of racers after every round of advancements will be automatically inputted into data files for calculating possible payoffs. The player can switch back and forth among the display of race-course, that of self-service wagering and that of possible payoffs. At the end of a race official results will be displayed.

BRIEF DESCRIPTION OF THE DRAWINGS

FIG. 3 shows a probability display provided by file 91416.

FIG. 4A shows a Win, Place, Show and Executa display provided by file Exscrn.

FIG. 4B shows a Win, Place, Show and Double display provided by file Dbscrn.

DESCRIPTION OF THE PREFERRED EMBODIMENT AND TYPES OF BETS

Figure 1:
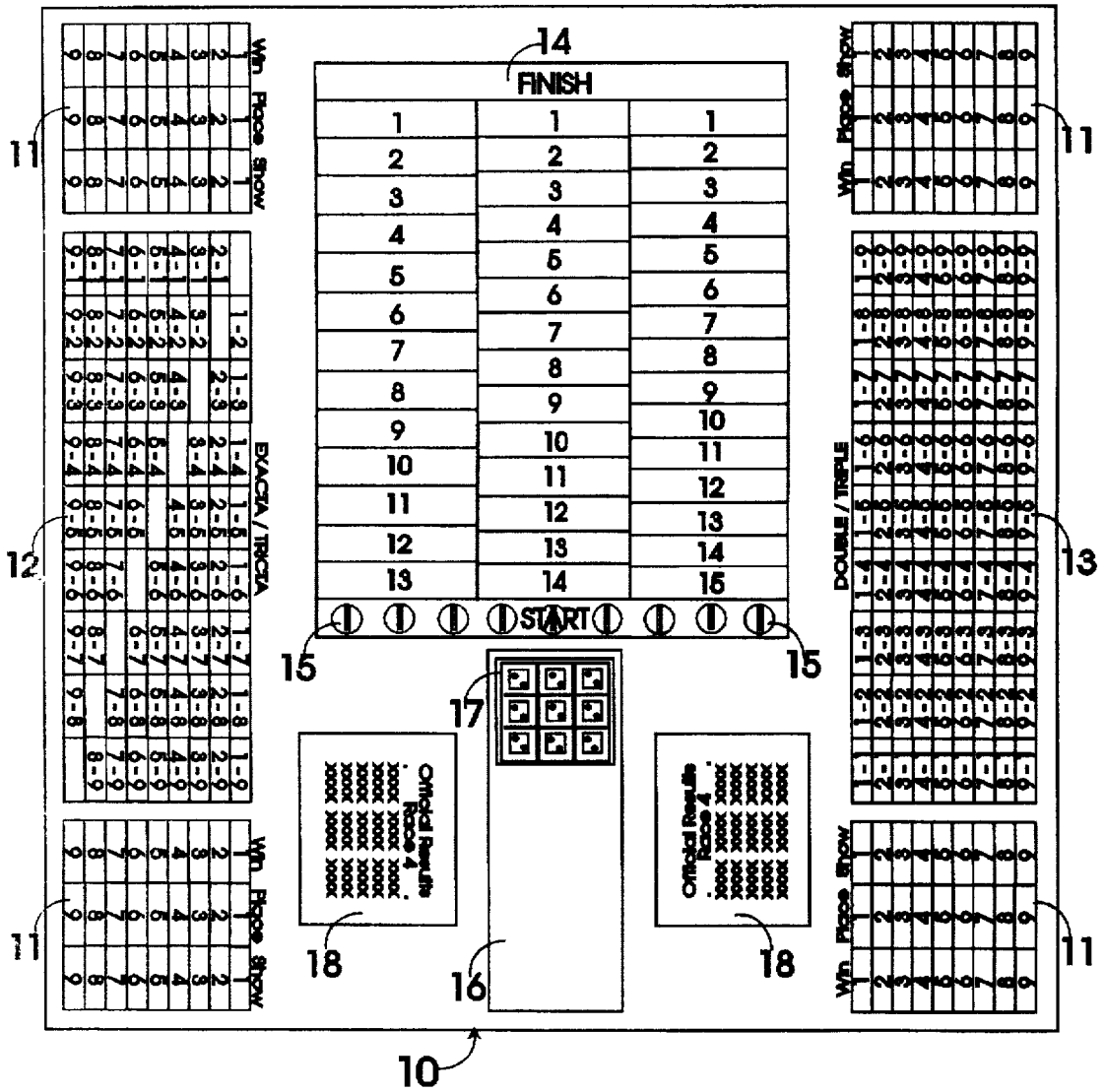
FIG. 1 is a top plan view of a preferred playing surface.
Figure 1A:
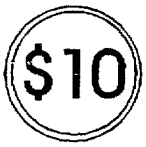
FIG. 1A shows the face of a betting chip.

The playing surface 10 has six betting zones, namely, four WIN-PLACE-SHOW zones 11, one EXACTA/TRICTA zone 12 and one DOUBLE/TRIPLE zone 13. There are numbered rectangulars in zones 11–13 for placing the following types of bets in cash or by betting chips as shown in FIG. 1A.:

1. Win of a certain number. The bet is to be placed in a space of that number in the "WIN" column of zone 11. The player making such a bet wins if the racer of that number finishes first.
2. Place of a certain number. The bet is to be placed in a space of that number in the "PLACE" column of zone 11. The player making such a bet wins if the racer of that number finishes first or second.

Figure 1B:
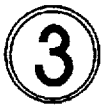
FIG. 1B shows the face of a numbered chip for triple or tricta bets.

3. Show of a certain number. The bet is to be placed in a space of that number in the "SHOW" column of zone 11. The player making such a bet wins if the racer of that number finishes first, second or third.
4. Exacta of a certain ordered pair of numbers. The bet is to be placed in a space of that ordered pair of numbers in zone 12. The player making such a bet wins if the racer of the first number finishes first and that of the second number finishes second.
5. Double of a certain ordered pair of numbers. The bet is to be placed in a space of that ordered pair of numbers in zone 13. The player making such a bet wins if the racer of the first number finishes first in that race and that of the second number finishes first in the following race.
6. Tricta (or Trifecta) of a certain ordered triple of numbers. The bet is to be placed together with a numbered chip as shown in FIG. 1B on a zone 12 space. The player making such a bet wins if the racer of the first number of EXACTA finishes first, that of the second number finishes second and that of the chip's number finishes third.
7. Triple (or Pick 3) of a certain ordered triple of numbers. The bet is to be placed together with a numbered chip as shown in FIG. 1B on a zone 13 space. The player making such a bet wins if the racer of the first number of DOUBLE finishes first in that race, that of the second number finishes first in the following race and that of the chip's number finishes first in the subsequent race.

Besides, there is a timing classification. A bet made ahead of the first roll of dice will be referred to as "Regular". A bet made between the first and second roll of dice will be referred to as "Second Chance". A bet made between the second and third roll of dice will be referred to as "Last Chance". Surface 10 has a race-course14.

Figure 1C:
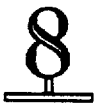
FIG. 1C is a side elevantional view of a numbered racer marker.

At the one end of race-course 14 there is a "START" and at the other end a "FINISH". Between them there are numbered spaces, called "Position 1", "Position 2", and so on, in three columns. Before the start of a race, all racers 15, represented each by a numbered marker as shown in FIG. 1C, are placed in the START from left to right such that Racers 1, 2 and 3 are facing the left column, Racers 4, 5 and 6 the middle column and Racers 7, 8 and 9 the right column. Racers 1, 2 and 3 will move from START to "Position 13", then "Position 12", and so on to FINISH. Racers 4, 5 and 6 will move from START to "Position 14", then "Position 13", and so on to FINISH. Racers 7, 8 and 9 will move from START to "Position 15", then "Position 14", and so on to FINISH.

Surface 10 has an area 16 for rolling a dice box 17.

Surface 10 has two rectangular openings 18 for compurter displaying possible payoffs and official results.

DESCRIPTION OF THE DICE BOX AND THE VALID ROLL

The dice box 17 comprises a transparent hollow cylinder, a revolving partition structure, a metal weight and nine dice.

Figure 2A:
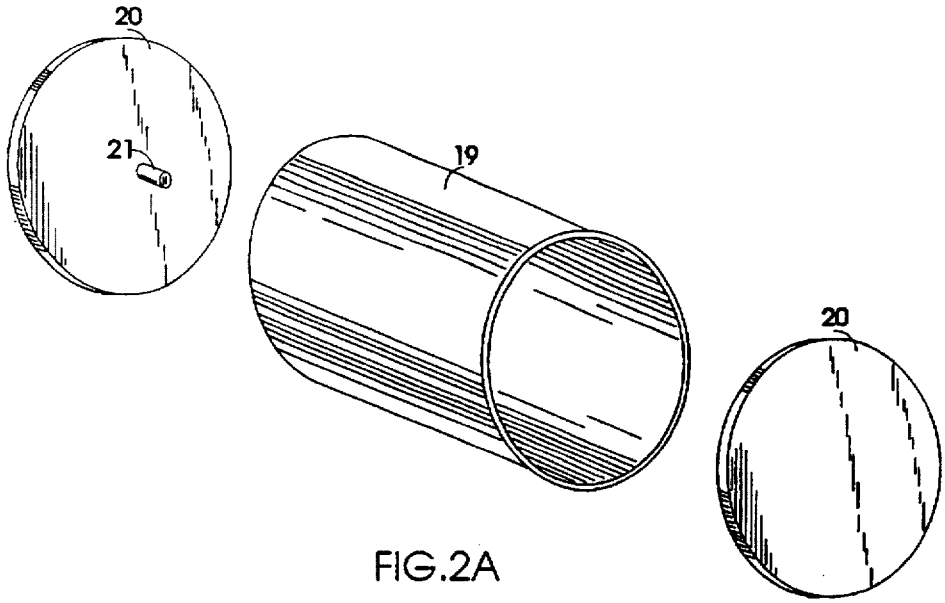
FIG. 2A is an isometric exploded view of a cylindrical box.
Figure 2B:
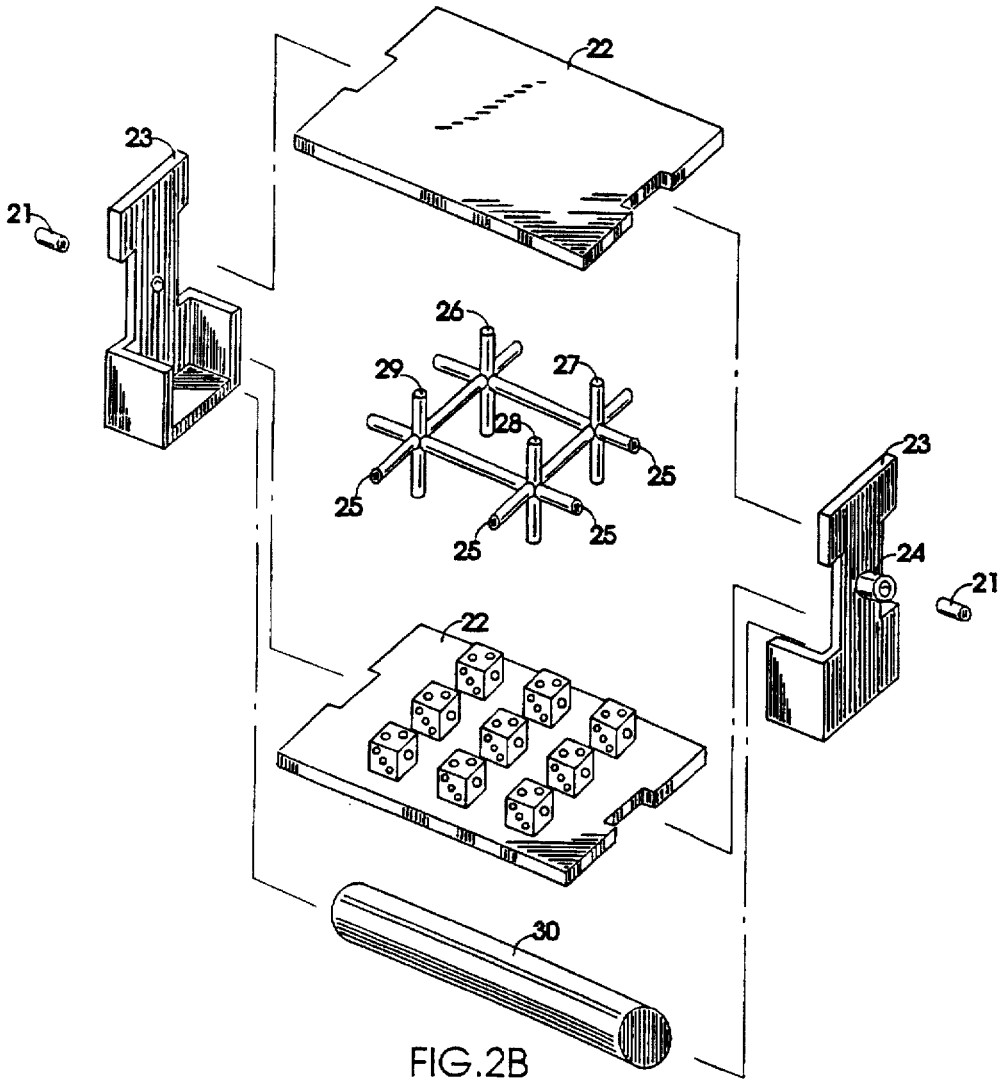
FIG. 2B is an isometric exploded view of a revolving partition structure.

The hollow cylinder comprises a tube 19 and two circular plates 20. On the inside face of each circular plate 20 there is at the center a stud 21 as shown in FIG. 2A. Studs 21 as shown in FIG. 2B are used as pivots on which the partition structure is mounted and hence about which the partition structure can revolve.

The partition structure has upper and lower rectangular plates 22. There are two vertical strips 23. In the middle of 23 there is a hole. The hole, extended by a short pipe 24, is to receive the stud 21. Not the whole strip 23, but only the end of 24 will touch the circular plate 20 of the hollow cylinder.

Within the space formed by plates 22 and strips 23 there are four horizontal bars 25 and four vertical bars 26–29. There is a plane determined by 26 and 27, another one by 27 and 28, a third one by 28 and 29 and a fourth one by 29 and 26. These four planes divide the space between plates 22 into nine compartments, each for housing one die.

All parts 22–29 are glued together at their joints to form a rigid structure. A cylindrical weight 30 is confined between the lower plate 22 and strips 23.

When the box is whirled, the partition structure will revolve due to the moment of inertia of weight 30. When the box comes to a standstill, the plates 22 will be held horizontal due to the gravity of weight 30.

A valid roll of the box must satisfy the following three conditions:

1. The box will be held by both hands, one at each end, and shaken and whirled.
2. The box will then be raised by both hands to above the forehead before being rolled on 16.
3. When the dice box comes to a standstill, its axis must be parallel to the end line of 16.

An otherwise invalid roll must be repeated.

Looking from the dice box roller the positions of dice after a valid roll form a three by three matrix.

The die of matrix element 11 represents Racer 1.
The die of matrix element 12 represents Racer 2
The die of matrix element 13 represents Racer 3.
The die of matrix element 21 represents Racer 4.
The die of matrix element 22 represents Racer 5.
The die of matrix element 23 represents Racer 6.
The die of matrix element 31 represents Racer 7.
The die of matrix element 32 represents Racer 8.
The die of matrix element 33 represents Racer 9.

PROBABILITY FORMULAE

A dice sequence of length n is a sequence of n rolled numbers of a die such as one of length 2 can be 1 1, 1 2, 1 3,... 2 1, 2 1, 2 3,... 3 1... 4 1,... 6 1,.. 6 6 or that of length 3 can be 1 1 1, 1 1 2,.. 6 1 1,.. 6 6 6.

Let g,i,j,k,l,m,n,p,t be natural numbers.

Let (n,l) denote a dice sequence of length n and value l which is a sequence of n rolled numbers of a die whose sum is l such as (3,10), can be 1 3 6, 1 4 5, 1 5 4, 1 6 3, 2 2 6, 2 3 5, 2 4 4, 2 5 3, 2 6 2,.. 6 1 3, 6 2 2 or 6 3 1.

Let R(n,l) denote the total number of possible (n,l).

In one roll we have $$R(1,1)=R(1,2)=\ldots=R(1,6)=1$$

$$R(1,l)=0 \text{ for } l>6$$

In exactly 2 rolls one can reach 2 (or 12) by 1 1 (by 6 6), thus $$R(2,2)=1=R(2,12)$$

In exactly 2 rolls one can reach 3 (or 11) by 1 2 or 2 1 (by 5 6 or 6 5), thus $$R(2,3)=2=R(2,11)$$

In exactly 2 rolls one can reach 4 (or 10) by 1 3 or 2 2 or 3 1 (by 4 6, 5 5 or 6 4), thus $R(2,4)=3=R(2,10)$ Similarly we have $R(2,5)=4=R(2,9)$ $R(2,6)=5=R(2,8)$ $R(2,7)=6$ $R(2,l)=0$ for $l>12$ For n>2 we derive a recursion formula as follows: Since every dice sequence (n,l) is a one-more-roll extension of a dice sequence (n−1,k) where k is any number between l−6 and l−1 we have $$R(n,l)=R(n-1,l-1)+R(n-1,l-2)+R(n-1,l-3)+..+R(n-1,l-6)$$

Replacing l by l−1 we have $$R(n,l-1)=R(n-1,l-2)+R(n-1,l-3)+R(n-1,l-4)+..+R(n-1,l-7)$$

Together

R(n,l)=R(n,l−1)+R(n−1,l−1)−R(n−1,l−7), a recursion formula

Note that R(n,l)=0 for l<n or 6n<l.

How to use the recursion formula?

First R(3,3)=0+R(2,2)−0, then one by one excluding R(n,l)=0 as follows $R(3,4)=R(3,3)+R(2,3)-0$ $R(3,5)=R(3,4)+R(2,4)-0$

..

$R(3,10)=R(3,9)+R(2,9)-R(2,3)$

..

$R(3,18)=..$ $R(4,4)=0+R(3,3)-0$ $R(4,5)=R(4,4)+R(3,4)-0$

..

$R(4,12)=R(4,11)+R(3,11)-R(3,5)$

..

$R(4,24)=..$ $R(5,5)=..$ $R(5,6)=..$ etc.

An effective (n,l)-sequence is a dice sequence of length n such that the sum of all rolled number excluding the last is at most l−1. In other words, it is an one-more-roll extension of a dice sequence of length n−1, value at most l−1, denoted ( n−1,<=l−1).

E.g., an effective (2,5)-sequence is x y such that x<5 an effective (3,9)-sequence is x y z such that x+y<9

The total number of effective (2,5)-sequences is obviously $6*[R(1,1)+R(1,2)+R(1,3)+R(1,4)]$ (* is multiplication)

The total number of effective (3,9)-sequences is obviously $6*[R(2,2)+R(2,3)+R(2,4)+..++R(2,8)]$ In general, the total number of effective (n,l)-sequences is $$6*[R(n-1,n-1)+R(n-1,n)+..+R(n-1,l-2)+R(n-1,l-1)]$$

A favorable (n,l)-sequence is an effective (n,l)-sequence of value at least l.

E.g., a favorable (2,5)-sequence is x y such that x<5 and x+y>4 a favorable (3,9)-sequence is x y z such that x+y<9 and x+y+z>8

All 6 one-more-roll extensions of a dice sequence (1,4) are favorable (2,5)-sequences. Only 5,4,3 respectively of 6 one-more-roll extensions of a dice sequence of length 1 and value 3,2,1 respectively are favorable (2,5)-sequences. Thus, the total number of favorable (2,5)-sequences is $$6*R(1,4)+5*R(1,3)+4*R(1,2)+3*R(1,1)$$

All 6 one-more-roll extensions of a dice sequence (2,8) are favorable (3,9)-sequences. Only 5,4,3,2,1 respectively of 6 one-more-roll extensions of a dice sequence of length 2 and value 7,6,5,4,3 respectively are favorable (3,9)-sequences. Thus, the total number of favorable (3,9)-sequences is $$6*R(2,8)+5*R(2,7)+4*R(2,6)+3*R(2,5)+2*R(2,4)+R(2,3)$$

In general, all 6 one-more-roll extensions of a dice sequence (n−1,l−1) are favorable (n,l)-sequences. Only 5,4,3,2,1 respectively of 6 one-more-roll extensions of a dice sequence of length n−1 and value l−2,l−3,l−4,l−5,l−6 respectively are favorable (n,l)-sequences.

Thus in general, the total number of favorable (n,l)-sequences is $$6*R(n-1,l-1)+5*R(n-1,l-2)+4*..+3*..+2*R(n-1,l-5)+R(n-1,l-6)$$

Let P(n,l) denote the probability of reaching l or higher in exactly n rolls without competition.

P(n,l) is equal to the total number of favorable (n,l)-sequences divided by the total number of effective (n,l)-sequences.

Now let's consider a simple game of rolling one die. The rule is that you win if you reach a sum of 8. Thus, you need a favorable (n,8)-sequence to win. But some other player may have won before you obtain such a sequence. That is, there is a certain chance, ch(n), for you to reach the n-th roll. The probability for you to win in exactly n rolls is thus P(n,8)*ch(n). Your total odds to win are $$P(2,8)*ch(2)+P(3,8)*ch(3)+P(4,8)*ch(4)+..+P(8,8)*ch(8).$$

Although P(n,l) is clarified, ch(n) remains to be figured out by other rules of the games.

For clearer notation, instead of Race 1, Race 2, etc. we call them Race A, Race B, in general Race M. Besides, we use [A]=1, [B]=2, etc., in general [M]=t.

Let us rule that the starter of Race M is Racer #t, followed by Racer #(t+1) cyclically. In the following the # sign will be omitted.

Let Tr(i) denote the track length of Racer i, i.e., the number of advancement spaces from start to finish.

For Race M let M(n,i) denote the probability of Racer i finishing Tr(i) first in competition in exactly n rolls.

$$M(n,i)=P(n,Tr(i))*ch(n,i)$$

where ch(n,i), the chance of reaching the n-th roll, is equal to [1-all M(n,i) listed ahead, if any] ordered as follows: The first n is 1 and the first i is t. Let i run from t to p and then from 1 to t−1, then increase n by one and run another cycle of i as before and so on till ch(n,i) is zero or immaterial.

Note that depending on Tr(i), M(n,i) can be zero for n being less than a certain number. For example, if Tr(i)>12, then no Racer can finish within 2 rolls, thus M(n,i)=0 for n<3.

Note that ch(n,i)=0 for all n>Tr(i). But to calculate n up to Tr(i) is laboured and unnecessary if ch(n,i) is immaterial for some number g smaller than Tr(i). We'll talk about some specific g later on.

The probability of Racer i finishing first is $$WM(i)=M(1,i)+M(2,i)+M(3,i)+..+M(g,i)$$

where g is an integer for which M(g,i) is immaterial.

For Race M let Mm(n,i,j) denote the probability of Racer j finishing Tr(j) in competition in exactly n rolls after Racer i has finished first in m rolls.

$$Mm(n,i,j)=P(n,Tr(i))*ch(n,i,j)$$

where ch(n,i,j), the chance of Racer j reaching the n-th roll, is equal to [1-all Mm(n,i,j) listed ahead, if any] ordered as follows: The first n is m and the first j is i+1 or 1 if i=p. Let j run from i+1 to p and then from 1 to i−1, then increase n by one and run another cycle of j as before and so on till ch(n,i,j) is immaterial.

In the calculation we have to set Mm(n,i,j)=0 when it is so, namely for i=j or for n=m and t<=j<i or for n=m and i<t<=j or for n=m and j<i<t The probability of Racer i finishing first and Racer j second is $$XM(i,j)=M(1,i)*[M1(1:i,j)+M1(2,i,j)+..+M1(g,i,j)]$$

$$+M(2,i)*[M2(2,i,j)+M2(3,i,j)+..+M2(g,i,j)]$$

$$+M(3,i)*[M3(3,i,j)+M3(4,i,j)+..+M3(g,i,j)$$

$$+....$$

$$+M(g,i)*M(g,i,j)$$

where g is an integer for which ch(g,i) is immaterial.

The probability of Racer j finishing first or second is $$PM(j)=WM(j)+XM(1,j)+XM(2,j)+XM(3,j)+..+XM(p,j)$$

For Race M let Mm(n,i,j,k) denote the probability of Racer k finishing Tr(k) in competition in exactly n rolls after Racer i has finished first in m rolls or less and Racer j second in m rolls.

$$Mm(n,i,j,k)=P(n,Tr(i))*ch(n,i,j,k)$$

where ch(n,i,j,k), the chance of Racer k reaching the n-th roll, is equal to [1-all Mm(n,i,j,k) listed ahead, if any] ordered as follows: The first n is m and the first k is j+1 which is 1 if j=p. Let k run from j+1 to p and then from 1 to j−1, then increase n by one and run another cycle of k as before and so on till ch(n,i,j,k) is immaterial.

In the calculation we have to set Mm(n,i,j,k)=0 when it is so, namely for i=j or i=k or j=k or for n=m and t<=i<j and t<=k<j or for n=m and t<=j<i or for n=m and i<j<=t and t<=k or for n=m and i<j<=t and k<j or for n=m and i<=t<=j or for n=m and j<=t<=i and t<=k or for n=m and j<=t<=i and k<j or for n=m and j<i<=t or for n=m+1 and t<=j<i and t<=k<j or for n=m+1 and i<=t<=j and t<=k<j or for n=m+1 and j<i<=t and t<=k or for n=m+1 and j<i<=t and k<j The probability of Racers i,j,k finishing 1st, 2nd and 3rd respectively is $$TM(i,j,k)=M(1,i)*\{M1(1,i,j)*[M1(1,i,j,k)+M1(2,i,j,k)+..+M1(g,i,j,k)]$$

$$+M1(2,i,j,k)*[M2(2,i,j,k)+M2(3,i,j,k)+..+M2(g,i,j,k)]$$

$$+M1(3,i,j,k)*[M3(3,i,j,k)+M3(4,i,j,k)+..]$$

$$+..$$

$$+M1(g,i,j)*Mg(g,i,j,k)\}$$

$$+M(2,i)*\{M2(2,ij)*[M2(2,i,j,k)+M2(3,i,j,k)+..+M2(g,i,j,k)]$$

$$+M2(3,i,j)*[M3(3,i,j,k)+M3(4,i,j,k)+..+M3(g,i,j,k)]$$

$$+M2(4,i,j)*[M4(4,i,j,k)+M4(5,i,j,k)+..]$$

$$+..$$

$$+M2(g,i,j)*Mg(g,i,j,k)\}$$

$$+M(3,i)*\{M3(3,i,j)*[M3(3,i,j,k)+..]$$

$$+..$$

$$+M3..\}$$

$$+M(4,i)*\{M4(4,i,j)*..$$

$$+..\}$$

$$+....$$

$$+M(g,i)*Mg(g,i,j)*Mg(g,i,j,k)$$

where g is an integer for which M(g,i) is immaterial.

The probability of Racer k finishing 1st, 2nd or 3rd is $$SM(k)=PM(k)+TM(1,2,k)+TM(1,2,k)+TM(1,3,k)+..+TM(1,p,k)$$

$$+TM(2,l,k)+TM(2,2,k)+TM(2,3,k)+..+TM(2,p,k)$$

$$+TM(3,l,k)+...$$

$$+..$$

$$+..+TM(p,p-1,k)+TM(p,p,k)$$

Now let's turn to the problem of chance being immaterial under the following assumptions: 1. There are nine racers. 2. Tr(i)<=16. 3. The race ends when three racers finish. Then ch(g,i), ch(g,i,j) ch(g,i,j,k) are all immaterial for g=7 for the following reason. The total number of R(7,7) to R(7,42) is 6^7=279936 (^ is exponent). Those of value less than 16 are: R(7,7)=1, R(7,8)=7, R(7,9)=28, R(7,10)=84, R(7,11)=210, R(7,12)=462, R(7,13)=917, R(7,14)=1667, R(7,15)=2807. Their sum is 6183. Thus, after seven rolls the chance of a racer having moved less than 16 spaces is 6183/279936<1/40. Thus, the chance that after 7 rolls 7 racers have moved less than 16 spaces is less than (1/40)^7 (the exponent 7 stands for racers not rolls) or one to ten million. Using a little more complicated method one can show that in a race with Tr(1)=Tr(2)=Tr(3)=14, Tr(4)=Tr(5)=Tr(6)=15, Tr(7)=Tr(8)=Tr(9)=16, the chance of needing a 7th roll is one out of 10.1 million.

Probably contrary to intuition probabilities of different situations are often equal.

When are two Exactas equal if Tr(1)=Tr(2)=Tr(3)=15, Tr(4)=Tr(5)=Tr(6)=16, Tr(7)=Tr(8)=Tr(9)=17?

For example, Race E $$XE(1,4)=XE(2,4)=XE(3,4)$$

$$XE(1,4)=E(3,1)*[E3(3,1,4)+E3(4,1,4)+E3(5,1,4)+..]+E(1,4)*[E(4,1,4)+..]+..$$

$$XE(2,4)=E(3,2)*[E3(3,2,4)+E3(4,2,4)+E3(5,2,4)+..]+E(2,4)*[E(4,2,4)+..]+..$$

$$XE(3,4)=E(3,3)*[E3(3,3,4)+E3(4,3,4)+E3(5,3,4)+..]+E(3,4)*[E(4,3,4)+..]+..$$

Here we have E(3,1)*E3(3,1,4)=E(3,2)*E3(3,2,4)=E(3,3)*E3(3,3,4)=P(3,15)P(3,16)[1−P(3,15)]^2 because $$E(3,1)=P(3,15)$$

$$E(3,2)=P(3,15)[1-E(3,1)]=P(3,15)[1-P(3,15)]$$

$$E(3,3)=P(3,15)[1-E(3,2)-E(2,3)]=P(3,15)[1-P(3,15)]^2$$

$$E3(3,1,2)=P(3,15)$$

$$E3(3,1,3)=P(3,15)[1-E3(3,1,2)]=P(3,15)[1-P(3,15)]$$

$$E3(3,1,4)=P(3,16)[1-E3(3,1,2)-E3(3,1,3)]=P(3,16)[1-P(3,15)]^2$$

$$E3(3,2,4)=P(3,16)[1-E3(3,1,2)]=P(3,16)[1-P(3,15)]$$

$$E3(3,3,4)=P(3,16)$$

Similarly we get E(3,1)*E3(4,1,4)=E(3,2)*E3(4,2,4)=E(3,3)*E3(4,3,4) etc.

In general, for given M,n,j(second):

$$M(n,i)*Mn(n',i,j)=M(n,ii)*Mn(n',ii,j)$$

if Tr(i)=Tr(ii) and neither [M] nor j is between i and ii.

When are two Trictas (Trifectas) equal?

For example, TE(6,1,4)=TE(6,2,4)=TE(6,3,4)

Here $$E3(3,6,1)*E3(3,6,1,4)=E3(3,6,2)*E3(3,6,2,4)=E3(3,6,3)*E3(3,6,3,4)$$

$$E3(3,6,1)*E3(4.6,1,4)=E3(3,6,2)*E3(4,6,2,4)=E3(3,6,3)*E3(4,6,3,4)$$

$$E3(3,6,1)*E3(5,6,1,4)=E3(3,6,2)*E3(5,6,2,4)=E3(3,6,3)*E3(5,6,3,4)$$

etc.

In general, for given M, n, i(first), k(third):

$$Mn(n',i,j)*Mn'(n'',i,j,k)=Mn(n',i,jj)*Mn'(n'',i,jj,k)$$

if Tr(j)=Tr(jj) and none of [M], i, k, is between j and jj.

Applying the above induction and deduction one can first set up (n,l), R(n,l) and P(n,l) for a race game of any number of racers, any track lengths and any numbers of advancement spaces per turn, not necessarily 1 to 6. Then according to the racing order ruled by the game (which can be in one turn racer i moves after j and reversely in another turn) one can set up M(n,i), Mm(n,i,j) and Mm(n,i,j,k) for calculating all kinds of probabilities for racers i,j,k finishing first, second and third. Besides, in the same art of forming Mm(n,i,j) and Mm(n,i,j,k) one can form Mm(n,i,j,k,l), Mm(n,i,j,k,l,h), etc. to figure out the probabilitity of a racer finishing 4th, 5th etc.

Exercise: Let there be 4 racers. Racers 1 and 2 have track length 3, racers 3 and 4 track length 4. Each turn every racer moves randomly 1 or 2 spaces. Show that $$XA(1,4)=XA(2,4)=0.035156=XB(3,1)=XB(4,1)$$

$$XA(3,1)=XA(4,1)=0.011719=XB(3,2)=XB(4,2)$$

$$XA(1,2)=0.105469=XB(1,2)$$

DESCRIPTION OF THE COMPUTER PROGRAMS

All programs are written in QBasic, known to be run without compiler but an interpreter included in every DOS 5.0+. They will each be called a file such as file 91416 or file Regula.

Note that it is easy to load, open, run or exit a Qbasic program as explained in every DOS 5.0+ manual.

Note that a computer program can execute the following actions: Calculating. Instructing a monitor to display something. Instructing a printer to print something. Creating or opening a data file to output some data. Opening a data file to input some data. Opening and running another program. Thus, unless specified otherwise, every above mentioned action in the description below will be executed automatically.

Each file contains a main program and most of them subroutines. Many subroutines are shared.

In order to avoid repeating the same calculation, some program files by the way create files to store calculated data. Although these files have individual names, they will in this description only be referred to as data files.

Files 91416, Regula, 2nd1st, Dealer and Dummy are written for keyboard users only. Files Screen0, Racing0, Racing1 and Racing2 are for the automatic game using a keyboard or screen activated machine. Files Exscrn, Dbscrn, Result and Betting are for keyboard users as well as users of screen activated machines and for the automatic game as well as non-automatic. However, file Betting can execute betting actions only if it is installed on a screen activated machine connected to a mainframe computer equipped with database wagering system. It will be clarified below in the Computer Program Listings which specific statements in a file are for which specific users or usages.

File 91416 is based on the probabilty formulae derived above under the condition that there are 9 racers with track lengths Tr(1)=14, Tr(2)=14, Tr(3)=14, Tr(4)=15, Tr(5)=15, Tr(6)=15, Tr(7)=16, Tr(8)=16, Tr(9)=16. File 91416 is to calculates probabilities related to Regular Bets. It also displays lengthy data step by step. It will request the user to enter a race number and sometimes also a racer number. Entering number 0 will pass to the next step. FIG. 3 gives an example of display provided by file 91416.

Since players are mostly interested in odds/payoffs, not probabilities, displays provided by all files except 91416 show one-dollar payoffs. They are exactly the inverses of probablities due to no profit margin modification. In the calculation formula there is a weight function Wt presently set to be 1. It is up to the game organizer to use other Wt based on profit margin. However, in order to avoid extreme prizes there is an upper bound of $999.99 set for Win, Place and Show bets and $9999.9 for other bets.

File Regula calculates probabilities related to Regular Bets and displays possible Win, Place, Show, Exacta and Double payoffs for all races one by one. It also creates data files to be used by files Exscrn, Dbscrn, Result, Racing0, Racing1 and Racing2.

File Dealer is to initiate a game. It requests the user to enter the race number and thus enables him to run files Exscrn and Dbscrn.

File Exscrn is to display possible payoffs for Win, Place, Show and Exacta bets. It relies on data files created by file Regula or 2nd1st. Displays provided by file Exscrn are similar and as shown in FIG. 4A. Besides race number they differ from one another by the terms "Regular", "Second Chance" or "Last Chance". FIG. 4A shows what to be seen on a screen activated machine. In the version for keyboard users there arc no such spots "BET" 34B, "Display WPS/Double" 34D or "Exit" 34X. Instead, the following instruction: Betting (b), Display WPS/Double (d) or Exit (x). Choosing 34B (pressing "b") will open file Betting. Choosing 34D (pressing "d") will open file Dbscrn. Choosing 34X (pressing "x") to Exit. For the automatic game Exit means closing file Exscrn and reopening the previous racing file Racing0, Racing1 or Racing2 whichever applicable. In the non-automatic game there is no Exit. The keyboard user can press any key to return to the Qbasic editor.

File Dbscrn is to do the same job as file Exscrn except showing possible payoffs for Double instead of Exacta. Displays provided by file Dbscrn are similar and as shown in FIG. 4B. FIG. 4B shows what to be seen on a screen activated machine. In the version for keyboard users there are no such spots "BET" 35B, "Display WPS/Exacta" 35E or "Exit" 35X. Instead, the following instruction: Betting (b), Display WPS/Exacta (e) or Exit (x). Everything else is just as explained in the case of file Exscrn.

File 2nd1st calculates probabilities related to Second/Last Chance Bets. It requests the user to specify Second Chance or Last Chance and to enter positions of racers. At the end of calculation it allows the user to run file Exscrn by pressing "e" or file Dbscrn by "d" or to exit by pressing any other key.

Figures 5, 6:
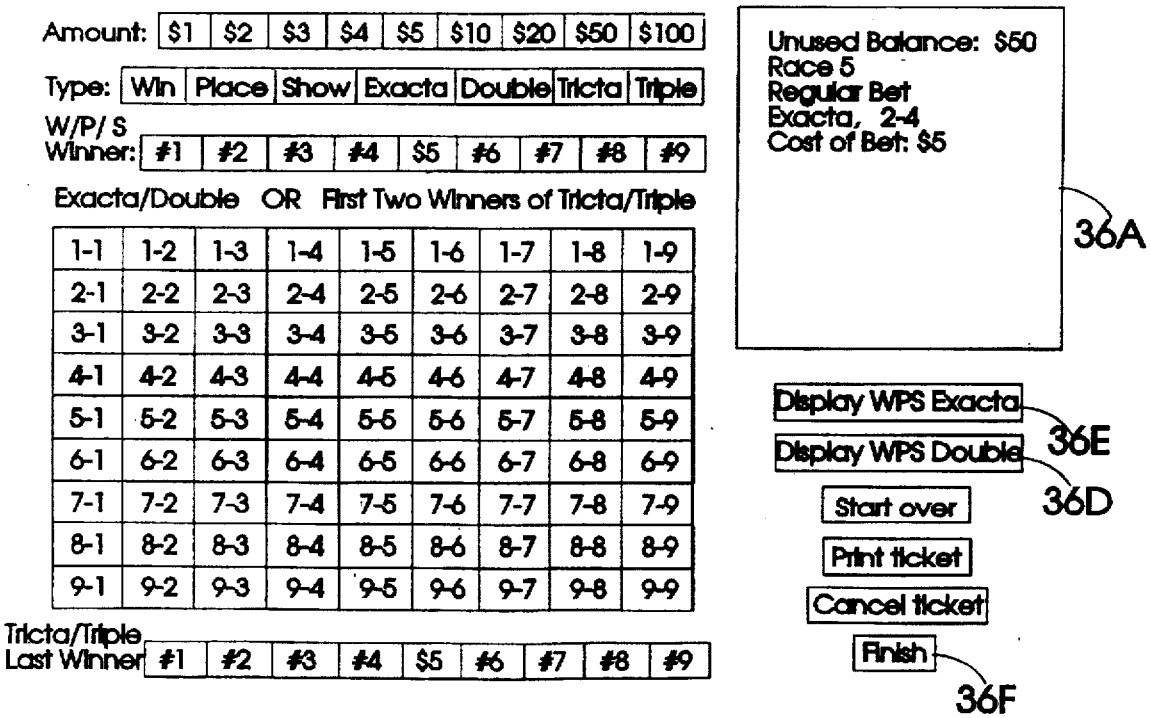
FIG. 5 shows a display for Official Results provided by file Result.
FIG. 6 shows a display for self-service wagering provided by file Betting.

File Result displays Official Results as shown in FIG. 5. The Reminder of playing the subsequent race is for the automatic game only. The non-automatic game player will be asked to enter the first, second and third place finisher numbers, while in the automatic case, those numbers will be inputted from data files created by file Racing2. Besides, in the automatic game an adjustable while after the display of Official Results file Screen0 will be opened.

File Betting provides a display similar to those shown on a screen activated self-service wagering machine available at a race track like Santa Anita Park. FIG. 6 illustrates such a display. All spots without a numeral are related to placing bets. Spot 36A indicates the betting activities. Spot 36E and 36D are for opening files Exscrn and Dbscrn respectively. In the non-automatic game spot 36F is simply to end the betting so that betting tickets and a voucher for unused balance will be printed. In the automatic game Spot 36F is to end the betting and to reopen the previous racing file Racing0, Racing1 or Racing2 whichever applicable. The keyboard user can press "e" to open file Exscrn, "d" to open file Dbscrn, "f" to reopen the applicable racing file and any other key to return to the Qbasic editor.

Figure 7A:
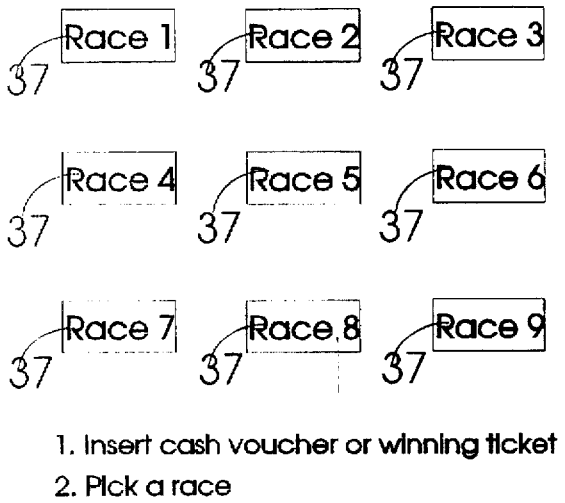
FIG. 7A is a display of the automatic game provided by file Screen0.

File Screen0 provides a display as shown in FIG. 7A for an automatic machine. The player can choose one of nine spots 37 or enter a number on kayboard to pick a race and thus open file Racing0.

Figure 7B:
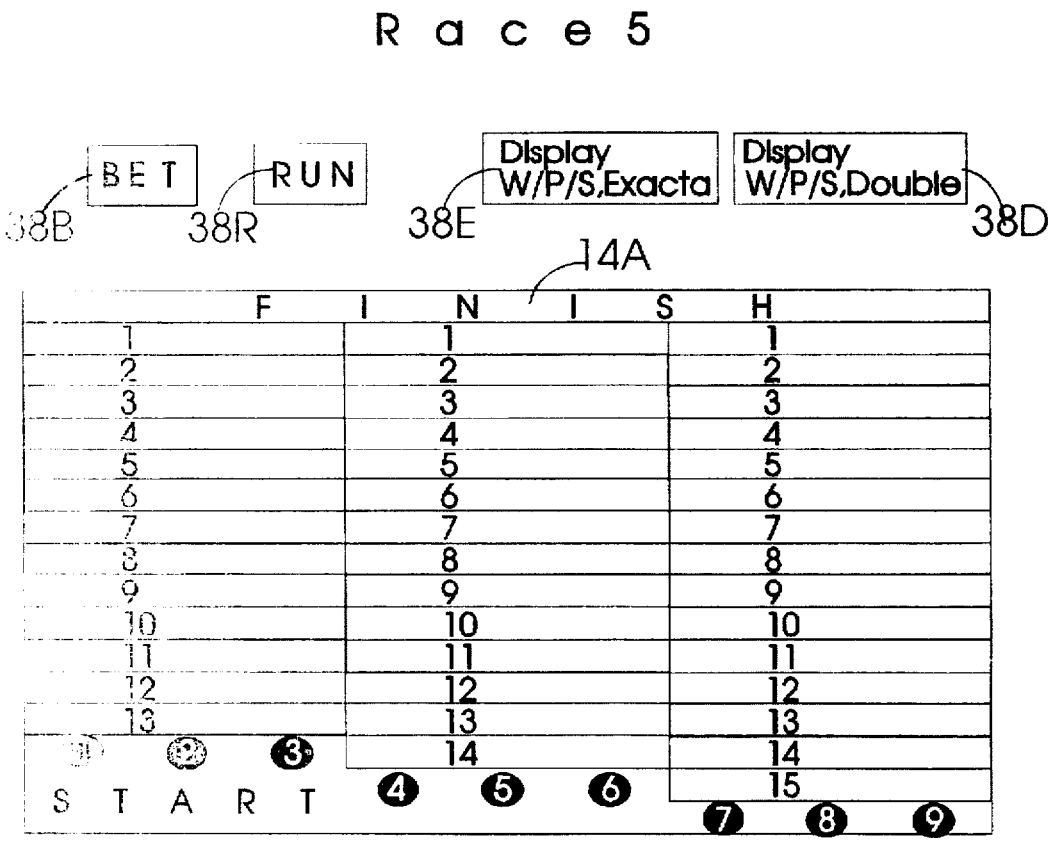
FIG. 7B shows a race-course display of the automatic game provided by file Racing0.

File Racing0 provides the display of a race-course 14A as shown in FIG. 7B where the racers are on the start line. There are no such spots "BET" 38B, "RUN" 38R, "Display WPS/Exacta" 38E or "Display WPS/Double" 38D in the version for keyboard users. Instead, the following instruction: Betting (b), Racing (r), Display WPS/Exacta (e), Display WPS/Double (d). Choosing a spot 38E or 38D (pressing "e" or "d") will open file Exscrn or Dbscrn for Regular payoffs. Choosing 38B (pressing "b") will open file Betting for Regular betting. Choosing "RUN" (pressing "r") will start the race. Consequently, a computer timer randomization will produce nine numbers from 1 to 6 randomly to determine the first round of advancements of racers. Racers on display move accordingly. Their new positions will be inputted to a data file and possible Second Chance payoffs will be calculated. At the end file Racing1 will be opened.

File Racing1 provides the display of a race-course 14A etc. just as file Racing0 except that the racers are now on the positions after the first round of advancements. Choosing 38E or 38D (pressing "e" or "d") will open file Exscrn or Dbscrn for Second Chance payoffs. Choosing 38B (pressing "b") will open file Betting for Second Chance betting. Choosing 38R (pressing "r") will continue the race. Consequently, a computer timer randomization will produce nine numbers from 1 to 6 randomly to determine the second round of advancements of racers. Racers on display move accordingly. Their new positions will be inputted to a data file and possible Last Chance payoffs will be calculated. At the end file Racing2 will be opened.

File Racing2 provides the display of a race-course 14A etc. just as file Racing0 except that the racers are now on the positions after the second round of advancements. Choosing 38E or 38D (pressing "e" or "d") will open file Exscrn or Dbscrn for Last Chance payoffs. Choosing 38B (pressing "b") will open file Betting for Last Chance betting. Choosing 38R (pressing "r") will continue the race. Consequently, a computer timer randomization will produce nine numbers from 1 to 6 randomly to determine the third round of advancements of racers. Racers on display move accordingly. Then the user will be repeatly requested to choose 38R (press "r") for further rounds of advancements until three racers finish. The first three finisher numbers will be inputted into a date file. Then a spot "Official Results" or an instruction for keyboard user shows up on the display for the player to open file Result.

File Dummy is to create data files with artificial data. The purpose is to prevent the running of any file from halting due to missing an actual race. Running file Dummy ahead will, for example, allow file Result to display Official Results for Race 4 without running any of Races 2, 3 or 4. Artificial data have no effects on real betting. They will be replaced by real data after an actual race.

DESCRIPTION OF THE NON-AUTOMATIC GAME

The game requires a playing surface together with racer markers, betting chips, and numeral chips such as the one explained in the description of the preferred embodiment.

The game requires a random number generator such as the one explained in the description of the dice box.

The game requires a mainframe computer equipped with a database wagering system similar to those available at a race track like Santa Anita Park. The databaes wagering system is to manage all bets and to check cash vouchers and winning tickets.

The game requires a personal computer called dealer's terminal connected to the mainframe computer. Files Regula, 2nd1st, Exscrn, Dbscrn, Result and Dummy are installed on the dealer's terminal. Files Regula and Dummy must be run ahead as a preparation for the game.

The game requires hand-held printers for issuing betting tickets. They will be connected to the mainframe computer.

As a desirable option the game requires self-service wagering machines similar to those available at a race track like Santa Anita Park. Each of them has a display, a slot to insert cash vouchers or winning tickets and a slot to output vouchers and betting tickets. Each of them contains a built-in computer called machine terminal connected to the mainframe computer. Files Betting, Exscrn and Dbscrn are installed on each machine terminal. Due to being connected to the mainframe computer, data related to possible payoffs will be supplied by the dealer's terminal; data related to betting activities by the database wagering system. Thus, players using these machines can place bets and watch payoff displays as specified below in step 41, 42, 46, 47, 51 and 52.

The game requires a designated player, called dealer, and a designated player, called dice thrower. The dealer and the dice thrower can be the same person.

The game consists of nine races, referred to as Race 1, Race 2 and so on. In each race there are nine racers represented by numbered markers. Before each race all racers are placed on the starting line as described in the description of playing surface. Every race has a so-called starter. The starter's number is the race number. Thus, for example, Racer 5 is the starter of race 5. After every roll of the dice the starter moves first, followed by the racer of next higher number, and so on. After Racer 9 comes Racer 1.

Figure 8:
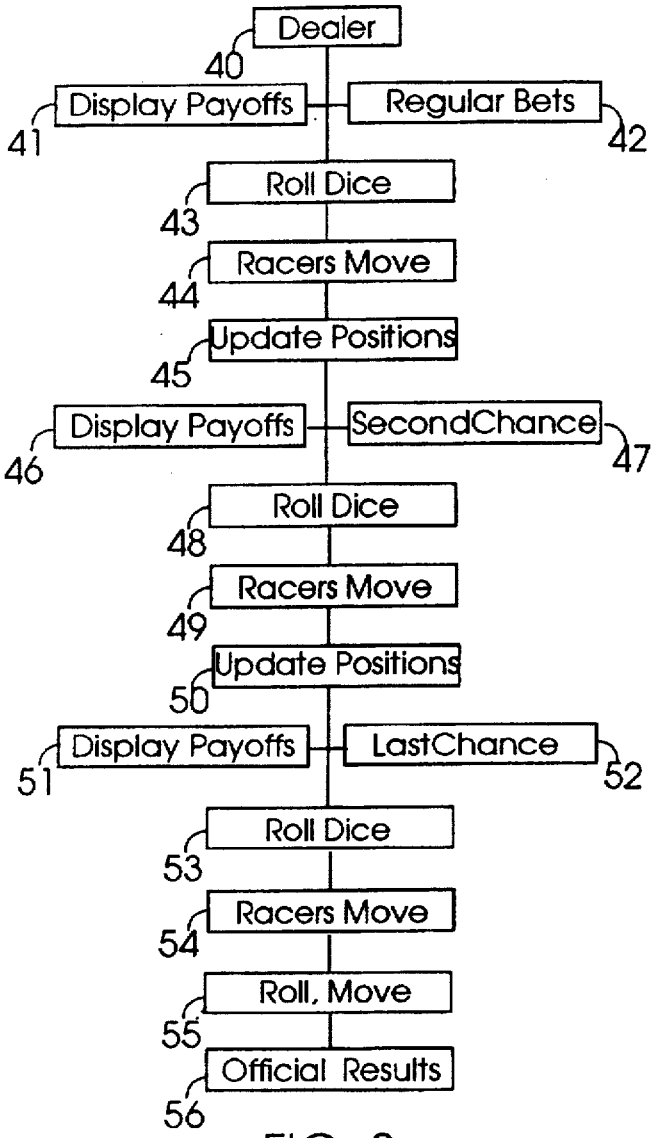
FIG. 8 is a flowchart illustrating the steps of a game using the playing surface.

Referring to FIG. 8, to start a game, the dealer turns on the dealer's terminal and opens (step 40) file Dealer to enter a race number. Then he opens file Exscrn so that one of the screens 18 will display (step 41) possible payoffs for the Regular Win, Place, Show and Exacta bets as shown in FIG. 4A. He also opens file Dbscrn so that the other screen 18 will display (step 41) possible payoffs for the Regular Win, Place, Show and Double bets as shown in FIG. 4B.

Players place (step 42) regular bets on rectangulars of betting zones 11–13. At any time seeing a bet placed, the dealer uses the hand-held printer to issue a ticket for the placed bet showing race number, type of bet, amount of bet and the time of the day. The ticket will be handed to the bettor. At the same time the betting token or money will be taken away by the dealer.

The dice thrower shakes, whirls and rolls (step 43) the dice box.

After a valid roll is made, the dealer moves (step 44) racers accordingly, that is, in the order ruled above and as many spaces as the sum of the pips showing on the representing die.

The dealer opens file 2nd1st to enter (step 45) the positions of racers. Then he opens files Exscrn and Dbscrn so that one of the screens 18 will display (step 46) possible payoffs for the Second Chance Win, Place, Show and Exacta bets as shown in FIG. 4A and the other screen 18 will display (step 46) possible payoffs for the Second Chance Win, Place, Show and Double bets as shown in FIG. 4B.

Players make (step 47) Second Chance bets just as step 42.

The dice thrower shakes, whirls and rolls (step 48) the dice box.

After a valid roll is made, the dealer moves (step 49) racers accordingly, that is, in the order ruled above and as many spaces as the sum of the pips showing on the representing die.

The dealer opens file 2nd1st to enter (step 50) the positions of racers. Then he opens files Exscrn and Dbscrn so that one of the screens 18 will display (step 51) possible payoffs for the Last Chance Win, Place, Show and Exacta bets as shown in FIG. 4A and the other screen 18 will display (step 51) possible payoffs for the Last Chance Win, Place, Show and Double bets as shown in FIG. 4B.

Players make (step 52) Last Chance bets just as step 47.

Steps 53 and 54 follow just as steps 48 and 49. If any racer reaches the finish line, the dealer will announce whether it is the first, second or third place finisher. If there are less than three finishers after the third roll, there will be a step 55 which is a repeat of steps 53 and 54. If any racer finishes, the dealer will announce whether it is the first, second or third place finisher. If there are still less than three finishers after the fourth roll, step 55 will be repeated till there are three ending a race.

The dealer opens file Result to enter the first, second and third place finisher numbers so that Official Results will be displayed (step 56) on screens18.

The dealer makes step 40 to start the next race. The general rule is that Race 1 is the first race, followed by Race 2, and so on.

DESCRIPTION OF THE AUTOMATIC VERSION

Just as the non-automatic game the automatic one is supposed to be played by many people at the same time. While there every race is run for all players here each individual player runs his own race.

The game requires a mainframe computer equipped with a database wagering system similar to those available at a race track like Santa Anita Park. The database wagering system is to manage all bets and to check cash vouchers and winning tickets.

Each individual player needs an automatic machine similar to those screen activated self-service wagering machines available at Santa Anita Park. All such machines are connected to the mainfrane computer.

The machine has a display screen, a slot to insert cash vouchers or winning tickets and a slot to output vouchers and betting tickets.

The machine contains a built-in computer called machine terminal connected to the mainframe computer. Files Exscrn, Dbscrn, Betting, Screen0, Racing0, Racing1, Racing2 and Result together with all data files created by fils Regula and Dummy must be loaded on each machine terminal.

The game consists of nine races as described in the description of the non-automatic game. There is only one difference, namely, no dice will be rolled. Instead, a computer timer randomization will be applied in files Racing0, Racing1 and Racing2 to produce nine numbers from 1 to 6 to determine one round of advancements of racers.

Figure 9:
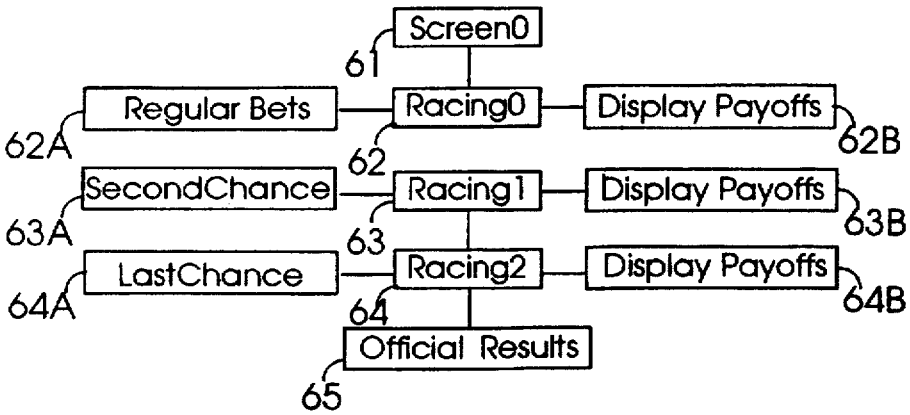
FIG. 9 is a flowchart illustrating the steps of a game using the automatic machine.

Referring now to FIG. 9, before the start of a game, there is (step 61) a display as shown in FIG. 7A provided by file Screen0. Picking a race by the player will switch to a display as shown in FIG. 7B provided by file Racing0.

The player has four choices. 1. Choosing 38B to open file Betting for making (step 62A) Regular bets as shown in FIG. 6. 2. Choosing 38E to open file Exscrn for viewing (step 62B) possible Regular payoffs as shown in FIG. 4A. 3. Choosing 38D to open file Dbscrn for viewing (step 62B) possible Regular payoffs as shown in FIG. 4B. 4. Choosing 38R to start (step 62) the race. The player can move around among files Betting, Exscrn and Dbscrn in any way he wants. If he however chooses 38R, file Racing0 will produce nine random numbers for the first round of advancements, move racers accordingly and update positions into a data file. At the end file Racing1 replaces Racing0.

The player again has four choices. 1. Choosing 38B to open file Betting for making (step 63A) Second Chance bets as shown in FIG. 6. 2. Choosing 38E to open file Exscrn for viewing (step 63B) possible Second Chance payoffs as shown in FIG. 4A. 3. Choosing 38D to open file Dbscrn for viewing (step 63B) possible Second Chance payoffs as shown in FIG. 4B. 4. Choosing 38R to continue (step 63) the race. The player can move around among files Betting, Exscrn and Dbscrn in any way he wants. If he however chooses 38R, file Racing 1 will produce nine random numbers for the second round of advancements, move racers accordingly and update positions into a data file. At the end file Racing2 replaces Racing1.

The player again has four choices. 1. Choosing 38B to open file Betting for making (step 64A) Last Chance bets as shown in FIG. 6. 2. Choosing 38E to open file Exscrn for viewing (step 64B) possible Last Chance payoffs as shown in FIG. 4A. 3. Choosing 38D to open file Dbscrn for viewing (step 64B) possible Last Chance payoffs as shown in FIG. 4B. 4. Choosing 38R to continue (step 64) the race. The player can move around among files Betting, Exscrn and Dbscrn in any way he wants. If he however chooses 38R, file Racing2 will produce nine random numbers for the third round of advancements, move racers accordingly. If there are less than three finishers, the player chooses 38R to produce another set of nine random numbers for advancements, and repeatedly if needed. If there are three finishers, file Racing2 will create a data file to output their numbers and display a spot "Official Result". The player chooses it to open (step 65) file Result for a display as shown in FIG. 5.

After an adjustable while file Result opens file Screen0 to provide a display as shown in FIG. 7A for the next race.

COMPUTER PROGRAM LISTINGS

Remarks

1. Main programs and their subroutines are shown in alphabetical order. Subroutines will be listed at the end of all main programs.

2. Files 91416, 2nd1st, Regula, Dealer and Dummy are written for keyboard users only. In other files there are statements ended with 'B, RBD, 'K, 'S, 'N, 'A 'NfD and 'R. for specific users or usages as explained below.

3. In file Betting there are statements ended with 'B such as "$1" shown in FIG. 6. All spots of 'B statements will be screen activated in cooperation with the database wagering system so that bets can be placed just as in the case of any screen activated self-service wagering machine at Santa Anita Park. Also in file Betting there are statements ended with 'RBD (Real Betting Data). The machine maker will ensure that real betting data specified by 'RBD statements will be supplied by the database wagering system.

4. Statements ended with 'K are for keyboard users. They will be included only if the file is installed on a computer with keyboard.

5. In any file, for every 'K statement for the keyboard user there exists a counterpart 'S statement for the screen activated machine. For example, "Display WPS/Exacta (e)" is a 'K statement whose counterpart 'S statement is "Display WPS/Exacta". Every 'K statement implies an action such as to open file Exscrn in response to pressing "e" in the above example. Every spot of 'S statement such as "Display WPS/Exacta" shown in FIG. 4A, 34E, will be screen activated so that choosing the spot will execute the same action such as to open file Exscrn.

6. In file Result there are statements ended with 'N. All 'N statements will be included only if the file is used in the non-automatic game. In file Result there are statements ended with 'A. All 'A statements will be included only if the file is used in the automatic game.

7. In files Dbscrn and Exscrn there is a statement ended with 'NfD (Not for Dealer) which will not be included if the file is installed on a dealer's terminal. There is also a statement ended with 'A which will be included if the file is used in an automatic game.

8. In subroutine Exdb there are statements ended with 'R. All 'R statements will be included only if the subroutine is subordinate to file Regula.

File 2nd1st

```
DEFINT A-Z: DEFSNG A, P, R-T, W: OPTION BASE 1
DECLARE SUB calc1R1 ( ): DECLARE SUB calc2P ( )
DECLARE SUB calc3N (r AS INTEGER, t AS INTEGER)
DECLARE SUB calc3N (r AS INTEGER, t AS INTEGER)
DECLARE SUB calc3O (r AS INTEGER, t AS INTEGER)
DECLARE SUB calc4IJ (r AS INTEGER, t AS INTEGER)
  :DECLARE SUB calc5XM (r AS INTEGER)
DECLARE SUB calc6IJK (r AS INTEGER, t AS
  INTEGER, i AS INTEGER)
DECLARE SUB calc7TM (r AS INTEGER, t AS
  INTEGER, i AS INTEGER)
DECLARE SUB calcPick1 (r AS INTEGER): DECLARE
  SUB calcPick1or2 (r AS INTEGER)
DECLARE SUB calcPick1or2or3 (r AS INTEGER)
  :DECLARE SUB calcPick2 (r AS INTEGER)
DECLARE SUB calcPick3 (r AS INTEGER): DECLARE
  SUB Exdb (r AS INTEGER, t AS INTEGER)
nR=7: mR=42: nP=7: mP=20: iA=9: nA=7
DIM SHARED Wt, Tr(iA), Trr(iA), R1(nR, mR), P(nP, mP),
  AM(nA, iA), AN(nA, iA), AO(nA, iA)
DIM SHARED WM(iA), WN(iA), WO(iA), PM(iA),
  SM(iA), WMN(iA, iA), WMNO(iA, iA, iA)
DIM SHARED AIJ(nA, nA, iA, iA), AXM(iA, iA), AIJK
  (nA, nA, iA, iA), ATM(iA, iA, iA), ist, ir
Tr(1)=14: Tr(2)=14: Tr(3)=14: Tr(4)=15: Tr(5)=15
Tr(6)=15: Tr(7)=16: Tr(8)=16: Tr(9)=16: Wt=1
CLS : CALL calc1R1: CALL calc2P: OPEN "race" FOR
  INPUT AS #1: INPUT #1, ist: CLOSE #1
LOCATE 3, 2: INPUT "Second Chance (s) or Last Chance
  (1)", c$: IF c$="s" THEN ir=2
IF c$="1" THEN ir=1
FOR i=1 TO 9: LOCATE i+4, 2: PRINT "Position Racer
  #"+LTRIM$(STR$(i));
INPUT " ", Trr(i): NEXT: CLS: OPEN "race" FOR OUT-
  PUT AS #1: PRINT #1, ist, ir: CLOSE #1
LOCATE 4, 2: PRINT "Please WAIT for calculating odds":
  CALL Exdb(ir, ist)
LOCATE 4, 1: PRINT SPACE$(80): LOCATE 25, 12:
PRINT "Display WPS/Exacta (e), Display WPS/Double (d),
  exit (any key)";
DO: a$=INKEY$: LOOP WHILE a$=" ": IF a$="e" THEN
  RUN "exscrn"
IF a$="d" THEN RUN "dbscrn": END
```

File 91416

```
DEFINT A-Z: DEFSNG A, P, R-T, W: OPTION BASE 1
DECLARE SUB calc1R1 ( ): DECLARE SUB calc2P ( )
DECLARE SUB calc3M (r AS INTEGER, t AS INTEGER)
DECLARE SUB calc3N (r AS INTEGER, t AS INTEGER)
DECLARE SUB calc3O (r AS INTEGER, t AS INTEGER)
DECLARE SUB calc4IJ (r AS INTEGER, t AS INTEGER)
  :DECLARE SUB calc5XM (r AS INTEGER)
```

```
DECLARE SUB calc6IJK (r AS INTEGER, t AS
  INTEGER, i AS INTEGER)
DECLARE SUB calc7TM (r AS INTEGER, t AS
  INTEGER, i AS INTEGER)
DECLARE SUB calcPick1 (r AS INTEGER): DECLARE
  SUB calcPick1or2 (r AS INTEGER)
DECLARE SUB calcPick1or2or3 (r AS INTEGER):
  DECLARE SUB calcPick2 (r AS INTEGER)
DECLARE SUB calcPick3 (r AS INTEGER): DECLARE
  SUB display5XM (t AS INTEGER)
DECLARE SUB display6IJK (r AS INTEGER, i AS
  INTEGER, j AS INTEGER)
DECLARE SUB display7TM (t AS INTEGER, i AS
  INTEGER)
DECLARE SUB displayPick1 (t AS INTEGER)
  :DECLARE SUB displayPick1or2 (t AS INTEGER)
DECLARE SUB displayPick1or2or3 (t AS INTEGER)
DECLARE SUB displayPick2 (t AS INTEGER):
  DECLARE SUB displayPick3 (t AS INTEGER)
DECLARE SUB Pick3Check ( ): DECLARE SUB
  TriCheck ( )
nR=7: mR=42: nP=7: nP=20: iA=9: nA=7
DIM SHARED Wt, Tr(iA), Trr(iA), R1(nR, mR), P(nP, mP),
  AM(nA, iA), AN(nA, iA), AO(nA, iA)
DIM SHARED WM(iA), WN(iA), WO(iA), WMN(iA, iA),
  WMNO(iA, iA, iA), PM(iA), SM(iA)
DIM SHARED AIJ(nA, nA, iA, iA), AXM(iA, iA), AIJK
  (nA, nA, iA, iA), ATM(iA, iA, iA), ist, ir
Tr(1)=14: Tr(2)=14: Tr(3)=14: Tr(4)=15: Tr(5)=15: Tr(6)=
  15: Tr(7)=16: Tr(8)=16
Tr(9)=16: ir=3: FOR i=1 to 9: Trr(i)=Tr(i): next: CLS :
  LOCATE 4, 36: INPUT "Race", ist
CALL calc1R1: CALL calc2P: CALL calc3M(ir, ist): CALL
  calcPick1(ir): CALL displayPick1(ist)
CALL calc4IJ(ir, ist): CALL calc5XM(ir): CALL
  display5XM(ist)
CALL calcPick1or2(ir): CALL displayPick1or2(ist): FOR
  i=1 TO 9: PRINT "Calculating Trictas":
PRINT " "+LTRIM$(STR$(i))+"is the winner": CALL
  calc7TM(ir, ist, I): NEXT
CALL TriCheck: CALL display7TM(ist, I): CALL
  calcPick1or2or3(ir)
CALL displayPick1or2or3(ist): CALL calc3N(ir, ist): CALL
  calcPick2(ir): CALL displayPick2(ist)
CALL calc3O(ir, ist): CALL calcPick3(ir): CALL
  displayPick3(ist): CALL Pick3Check: END
File Betting
OPEN "race" FOR INPUT AS 1: INPUT #1, ist, ir: CLOSE
  #1: SCREEN 12
LOCATE 2, 2: PRINT "Amount: $1 $2 $3 $4 $5 $10 $20
  $50 $100" 'B
LINE (80, 10)-(410, 10): LINE (80, 32)-(410, 32): FOR i=0
  TO 5
LINE (80+i*32, 10)-(80+i*32, 32): NEXT: FOR i=0 TO 2
LINE (280+i*40, 10)-(280+i*40, 32): NEXT: LINE (410,
  10)-(410, 32)
LOCATE 4, 2: PRINT "Type: Win Place Show Exacta
  Double Tricta Triple" 'B
LINE (52, 40)-(410, 40): LINE (52, 62)-(410, 62): LINE
  (52, 40)-(52, 62): LINE (96, 40)-(96, 62)
LINE (146, 40)-(146, 62): FOR i=0 TO 3:LINE (188+i*56,
  40)-(188+i*56, 62): NEXT
LINE (410, 40)-(410, 62): LOCATE 5, 2: PRINT "W/P/S":
  LOCATE 6, 2
PRINT "Winner #1 #2 #3 #4 #5 #6 #7 #8 #9" 'B
LINE (104, 74)-(392, 74): LINE (104, 94)-(392, 94): FOR
  i=0 TO 9
LINE (104+i*32, 74)-(104+i*32, 94): NEXT: LOCATE 7, 2
PRINT "Exacta/Double OR First Two Winners of Tricta/
  Triple": FOR i=1 TO 9: FOR j=1 TO 9
LOCATE 7+i*2, 5*j: PRINT LTRIM$(STR$(i))+"-"+
  LTRIM$(STR$(j)); : NEXT: NEXT
FOR i=0 TO 9: LINE (23, 112+i*32)-(383, 112+i*32):
  NEXT: FOR i=0 TO 9
LINE (23+i*40, 112)-(23+i*40, 400): NEXT: LOCATE 26,
  2: PRINT "Tricta/Triple"
LOCATE 27, 2: PRINT "Last Winner #1 #2 #3 #4 #5 #6 #7
  #8 #9" 'B
LINE (104, 412)-(392, 412): LINE (104, 432)-(392, 432):
  FOR i=0 TO 9
LINE (104+i*32, 412)-(104+i*32, 432): NEXT
LOCATE 2, 58: PRINT "Unused Balance: $50" 'RBD
LOCATE 3, 62: PRINT "Race"+LTRIM$(STR$(ist)):
  LOCATE 4, 58
IF ir=3 THEN PRINT "Regular Bet"
IF ir=2 THEN PRINT "Second Chance Bet"
IF ir=1 THEN PRINT "Last Chance Bet"
LOCATE 5, 58: PRINT "Exacta, 2-4": LOCATE 6, 58:
  PRINT "Cost of Bet: $5" 'RBD
LINE (450, 10)-(620, 220), , B: LOCATE 16, 59: PRINT
  "Display WPS/Exacta" 'S
LOCATE 18, 59: PRINT "Display WPS/Double" 'S
FOR i=0 TO 1: LINE (460, 232+i*32)-(610,260+i*32),, B:
  NEXT
LOCATE 20, 63: PRINT "Start over": LOCATE 22, 62:
  PRINT "Print Ticket" 'B
LOCATE 24, 62: PRINT "Cancel Ticket" 'B
LOCATE 26, 65: PRINT "Finish" 'B 'S
REM in the non-automatic game "Finish" means "Print
  Ticket" and "Print voucher for unused balance"
REM Hi the automatic game "Finish" also means "Return to
  Race"
FOR i=0 TO 2: LINE (480, 296+i*32)-(594, 324+i*32),, B:
  NEXT
LINE (488, 392)-(586, 424),, B: LOCATE 28, 2
PRINT "Betting (b), Display WPS/Exacta (e), Display
  WPS/Double (d), Finish (f)" 'K
DO: a$=INKEY$: LOOP WHILE a$="": IF a$="e" THEN
  RUN "exscrn"
IF a$="d" THEN RUN "dbscrn"
IF ir=3 AND a$="f" THEN RUN "racing0"
IF ir=2 AND a$="f" THEN RUN "racing1"
IF ir=1 AND a$="f" THEN RUN "racing2"
File Dealer
CLS : LOCATE 3, 2: INPUT "enter race number", ist
OPEN "race" FOR OUTPUT AS #1: PRINT #1, ist, 3:
  CLOSE #1: LOCATE 6, 2:
PRINT "Display WPS/Exacta (e), Display WPS/Double (d),
  exit (any key)";
DO: a$=INKEY$: LOOP WHILE a$="": IF a$="e" THEN
  RUN "exscrn"
IF a$="d" THEN RUN "dbscrn"
File Dbscrn
SCREEN 12: title$="NINE DICE $1 (ONE DOLLAR)
  PAYOFFS": LOCATE 1, (80-LEN(title$)) /2
PRINT title$: OPEN "race" FOR INPUT AS #1: INPUT #1,
  ist, ir: CLOSE #1: LOCATE 2, 28
PRINT "RACE"+LTRIM$(STR$(ist)): LOCATE 2, 40: IF
  ir=3 THEN PRINT "Regular Bets"
IF ir=2 THEN PRINT "Second Chance"
IF ir=1 THEN PRINT "Last Chance":
LOCATE 4, 1: PRINT "Racer#": FOR i=1 TO 9: LOCATE
  4, 9+(i-1)*8: PRINT i: NEXT
LOCATE 6, 1: PRINT "WIN": ifn$=LTRIM$(STR$(ist))+
  "WIN"+"."+LTRIM$(STR$(3-ir))
```

```
OPEN ifn$ FOR INPUT AS #1: FOR i=1 TO 9: INPUT #1,
  pay: LOCATE 6, 7+(i-1)*8
PRINT USING "###.##"; pay: NEXT: CLOSE #1:
  LOCATE 8, 1: PRINT "PLACE":
ifn$=LTRIM$(STR$(ist))+"PLACE"+"."+LTRIM$(STR$
  (3-ir))
OPEN ifn$ FOR INPUT AS #1: FOR i=1 TO 9: INPUT #1,
  pay
LOCATE 8,7+(i-1)*8: PRINT USING "###.##"; pay:
  NEXT: CLOSE #1: LOCATE 10, 1
PRINT "SHOW": ifn$=LTRIM$(STR$(ist))+"SHOW"+
  "."+LTRIM$(STR$(3-ir))
OPEN ifn$ FOR INPUT AS #1: FOR i=1 TO 9: INPUT #1,
  pay
LOCATE 10, 7+(i-1)*8: PRINT USING "###.##"; pay:
  NEXT: CLOSE #1: title$="DOUBLE"
LOCATE 12, (80-LEN(title$))/2: PRINT title$: LOCATE
  13, 1: PRINT "Racer#"
FOR i=1 TO 9: LOCATE 13, 10+(i-1)*8: PRINT "&"+
  LTRIM$(STR$(i)): NEXT
ifn$=LTRIM$(STR$(ist))+"double"+"."+LTRIM$(STR$
  (3-ir)):OPEN ifni$ FOR INPUT AS #1
FOR i=1 TO 9: LOCATE i+13,2: PRINT STR$(i)+"& ":
  FORj=1 TO 9: INPUT #1, pay
LOCATE i+13, 7+(j-1)*8: PRINT USING "####.#"; pay:
  NEXT: NEXT: CLOSE #1
LOCATE 26, 14: PRINT "Betting Display WPS/Exacta" 'S
LOCATE 26, 59: PRINT "Exit" 'S, 'A
LINE (90, 396)-(170, 416),, B: LINE (234, 396)-(388, 416),,
  B: LINE (454, 396)-(500, 416),, B
PRINT: PRINT "Betting (b), Display WPS/Exacta (e), Exit
  (x)" 'K, 'NfD
DO: a$=INKEY$: LOOP WHILE a$="": IF a$="e" THEN
  RUN "exscrn":
IF a$="b" THEN RUN "betting"
IF a$="x" AND ir=3 THEN RUN "racing0"
IF a$="x" AND ir=2 THEN RUN "racing1"
IF a$="x" AND ir=1 THEN RUN "racing2"
File Dummy
PRINT "creating Winner": FOR i=1 TO 9
OPEN "RACE"+LTRIM$(STR$(i)) FOR OUTPUT AS #1
FOR j=1 TO 3: p=(i+j-1) MOD (9)+1: PRINT #1, p; NEXT:
  CLOSE #1: NEXT
PRINT "creating Position": FOR i=1 TO 9
OPEN LTRIM$(STR$(i))+"RACE.1" FOR OUTPUT AS
  #1
PRINT#1, 10; 10; 10; 11; 11; 11; 12; 12; 12: CLOSE#1:
  NEXT: PRINT "creating Position":
FOR i=1 TO 9: OPEN LTRIM$(STR$(i))+"RACE.2" FOR
  OUTPUT AS #1
PRINT #1, 6; 6; 6; 7; 7; 7; 8; 8; 8: CLOSE #1: NEXT
PRINT "creating Win": FOR h=1 TO 2: FOR i=1 TO 9
OPEN LTRIM$(STR$(i))+"Win."+LTRIM$(STR$(h))
  FOR OUTPUT AS #1
FOR j=1 TO 9: PRINT #1, 0;: NEXT: CLOSE #1: NEXT:
  NEXT
PRINT "creating Place": FOR h=1 TO 2: FOR i=1 TO 9
OPEN LTRIM$(STR$(i))+"Place."+LTRIM$(STR$(h))
  FOR OUTPUT AS #1
FOR j=1 TO 9: PRINT #1, 0;: NEXT: CLOSE #1: NEXT:
  NEXT
PRINT "creating Show": FOR h=1 TO 2: FOR i=1 TO 9
OPEN LTRIM$(STR$(i))+"Show."+LTRIM$(STR$(h))
  FOR OUTPUT AS #1
FOR j=1 TO 9: PRINT #1, 0;: NEXT: CLOSE #1: NEXT:
  NEXT
PRINT "creating Exacta": FOR h=1 TO 2: FOR i=1 TO 9
OPEN LTRIM$(STR$(i))+"Exacta."+LTRIM$(STR$(h))
  FOR OUTPUT AS #1
FOR j=1 TO 81: PRINT #1, 0;: NEXT: CLOSE #1: NEXT:
  NEXT
PRINT "creating Double": FOR h=1 TO 2: FOR i=1 TO 9
OPEN LTRIM$(STR$(i))+"Double."+LTRIM$(STR$(h))
  FOR OUTPUT AS #1
FOR j=1 TO 81: PRINT #1, 0;: NEXT: CLOSE #1: NEXT:
  NEXT
PRINT "creating Tricta": FOR h=1 TO 2: FOR i=1 TO 9
OPEN LTRIM$(STR$(i))+"Tricta."+LTRIM$(STR$(h))
  FOR OUTPUT AS #1
FOR j=1 TO 729: PRINT #1, 0; : NEXT: CLOSE #1: NEXT:
  NEXT
PRINT "creating Triple": FOR h=1 TO 2: FOR i=1 TO 9
OPEN LTRIM$(STR$(i))+"Triple."+LTRIM$(STR$(h))
  FOR OUTPUT AS #1
FOR j=1 TO 729: PRINT #1, 0;: NEXT: CLOSE #1: NEXT:
  NEXT: END
File Exscrn
SCREEN 12: title$="NINE DICE $1 (ONE DOLLAR)
  PAY-OFFS": LOCATE 1, (80-LEN(title$))/2
PRINT title$: OPEN "race" FOR INPUT AS #1: INPUT #1,
  ist, ir: CLOSE #1: LOCATE 2, 28
PRINT "RACE"+LTRIM$(STR$(ist)): LOCATE 2, 40: IF
  ir=3 THEN PRINT "Regular Bets"
IF ir=2 THEN PRINT "Second Chance"
IF ir=1 THEN PRINT "Last Chance":
LOCATE 4, 1: PRINT "Racer#": FOR i=1 TO 9: LOCATE
  4, 9+(i-1)*8: PRINT i: NEXT
LOCATE 6, 1: PRINT "WIN": ifn$=LTRIM$(STR$(ist))+
  "WIN"+"."+LTRIM$(STR$(3-ir))
OPEN ifn$ FOR INPUT AS #1: FOR i=1 TO 9: INPUT #1,
  pay: LOCATE 6, 7+(i-1)*8
PRINT USING "###.##"; pay: NEXT: CLOSE #1:
  LOCATE 8, 1: PRINT "PLACE"
ifn$=LTRIM$(STR$(ist))+"PLACE"+"."+LTRIM$(STR$
  (3-ir))
OPEN ifn$ FOR INPUT AS #1: FOR i=1 TO 9: INPUT #1,
  pay
LOCATE 8, 7+(i-1) *8: PRINT USING "###.##"; pay:
  NEXT: CLOSE #1: LOCATE 10, 1
PRINT "SHOW": ifn$=LTRIM$(STR$(ist))+"SHOW"+
  "."+LTRIM$(STR$(3-ir))
OPEN ifn$ FOR INPUT AS #1: FOR i=1 TO 9: INPUT #1,
  pay
LOCATE 10, 7+(i-1)*8: PRINT USING "###.##"; pay:
  NEXT: CLOSE #1: title$="EXACTA"
LOCATE 12, (80-LEN(title$))/2: PRINT title$: LOCATE
  13, 1: PRINT "Racer#"
FOR i=1 TO 9: LOCATE 13, 10+(i-1)*8: PRINT "&"+
  LTRIM$(STR$(i)): NEXT
ifn$=LTRIM$(STR$(ist))+"exacta"+"."+LTRIM$(STR$
  (3-ir))
OPEN ifn$ FOR INPUT AS #1: FOR i=1 TO 9: LOCATE
  i+13, 2: PRINT STR$(i)+"&"
FOR j=1 TO 9: INPUT #1, pay: LOCATE i+13,7+(j-1)*8
IF i=j THEN PRINT "------" ELSE PRINT USING
  "####.#"; pay
NEXT: NEXT: CLOSE #1
LOCATE 26, 14: PRINT "Betting Display WPS/Double" 'S
LOCATE 26, 59: PRINT "Exit" 'S, 'A
LINE (90, 396)-(170, 416),, B: LINE (234, 396)-(388, 416),,
  B: LINE (454, 396)-(500, 416),, B
PRINT: PRINT "Betting (b), Display WPS/Double (d), Exit
  (x)" 'K, 'NfD
DO: a$=INKEY$: LOOP WHILE a$="": IF a$="d" THEN
  RUN "dbscrn"
```

```
IF a$="b" THEN RUN "betting"
IF a$="x" AND ir=3 THEN RUN "racing0"
IF a$="x" AND ir=2 THEN RUN "racing1"
IF a$="x" AND ir=1 THEN RUN "racing2"
File Racing0
DEFINT A-Z: DEFSNG A, P, R-T, W: OPTION BASE 1
DECLARE SUB calc1R1 ( ): DECLARE SUB calc2P ( )
DECLARE SUB calc3M (r AS INTEGER, t AS INTEGER)
DECLARE SUB calc3N (r AS INTEGER, t AS INTEGER)
DECLARE SUB calc3O (r AS INTEGER, t AS INTEGER)
DECLARE SUB calc4IJ (r AS INTEGER, t AS INTEGER)
DECLARE SUB calc5XM (r AS INTEGER)
DECLARE SUB calc6IJK (r AS INTEGER, t AS
  INTEGER, i AS INTEGER)
DECLARE SUB calc7TM (r AS INTEGER, t AS
  INTEGER, i AS INTEGER)
DECLARE SUB Exdb (r AS INTEGER, t AS INTEGER)
DECLARE SUB calcPick1 (r AS INTEGER): DECLARE
  SUB calcPick1or2 (r AS INTEGER)
DECLARE SUB calcPick1or2or3 (r AS INTEGER)
DECLARE SUB calcPick2 (r AS INTEGER): DECLARE
  SUB calcPick3 (r AS INTEGER)
nR=7: mR=42: nP=7: mP=20: iA=9: nA=7
DIM SHARED Wt, Tr(iA), Trr(iA), R1(nR, mR), P(nP, mP),
  AM(nA, iA), AN(nA, iA), AO(nA, iA)
DIM SHARED WM(iA), WN(iA), WO(iA), PM(iA),
  SM(iA), WMN(iA, iA), WMNO(iA, iA, iA)
DIM SHARED AIJ(nA, nA, iA, iA), AXM(iA, iA), AIJK
  (nA, nA, iA, iA), ATM(iA, iA, iA), ist, ir
Tr(1)=14: Tr(2)=14: Tr(3)=14: Tr(4)=15: Tr(5)=15
Tr(6)=15: Tr(7)=16: Tr(8)=16: Tr(9)=16: Wt=1
OPEN "race" FOR INPUT AS #1: INPUT #1, ist: CLOSE
  #1
DIM a(70), rc%(10), hn(10), x(10), y(10), ym(10), horse
  (10), n(6)
RANDOMIZE TIMER: Esc$=CHR$(27): blank$=SPACE$
  (80)
SCREEN 12: first=0: r%=RND*9: kolor(1)=14: kolor(2)=
  15: kolor(3)=6
COLOR 10: LOCATE 2, 29: PRINT "N I N E D I C E"
COLOR 10: LOCATE 4, 34: PRINT "Race"+LTRIM$
  (STR$(ist))
LOCATE 7, 6: PRINT "B E T": LOCATE 7, 18: PRINT "R
  U N" 'S
LOCATE 7, 51: PRINT "WPS/Exacta": LOCATE 7, 66:
  PRINT "WPS/Double" 'S
COLOR 8: LINE (38, 92)-(82, 112), 4, B: LINE (133,
  92)-(177, 112), 4, B
LINE (388, 9)-(488, 112), 4, B: LINE (508, 92)-(608, 112),
  4, B
COLOR 10: win %=500: win=1: first=1: FOR i=11 TO 29:
  LOCATE i, 1: PRINT blank$;: NEXT
COLOR 2: LOCATE 12, 28: PRINT "F I N I S H";
LOCATE 28, 12: PRINT "S T A R T";
FOR i=0 TO 17: LINE (20, 175+i*16)-(620, 175+i*16), 2
IF i>0 AND i<16 THEN
IF i<14 THEN LOCATE 12+i, 12: PRINT i;
IF i <15 THEN LOCATE 12+i, 35: PRINT I;: LOCATE
  12+i, 60: PRINT i;
END IF: IF i<4 THEN LINE (20+i*200, 192)-(20+i*200,
  432), 2
NEXT: LOCATE 26, 4: PRINT " "
LOCATE 27, 4: PRINT " ";
FOR i=1 TO 9: i3=INT(i/3.1): hn(i)=i: horse(i)=0
rc%(i)=(r%+i) MOD 16: x(i)=64*i -7: y(i)=399+i3*16:
  ym(i)=y(i)
IF rc%(i)=0 THEN rc%(i)=10: IF rc%(i)=8 THEN rc%(i)=
  15
COLOR rc%(i): LOCATE 26+i3, i*8: PRINT i;
CIRCLE (x(i)+10, y(i)+8), 10, rc%(i),,, .8: NEXT: LOCATE
  10, 3
PRINT "Betting (b), Racing (r), Display WPS/Exacta (e),
  Display WPS/Double (d)" 'K
DO: a$=INKEY$: LOOP WHILE a$="": IF a$="b" THEN
  RUN "betting"
IF a$="e" THEN RUN "exscrn"
IF a$="d" THEN RUN "dbscrn"
FOR i=1 TO 5: LOCATE 5+i, 1: PRINT blank$: NEXT:
  h=ist: counter=0
DO WHILE counter<9: counter=counter+1: FOR i=1 TO
  9999: NEXT
ym(h)=ym(h)-(INT(1000000*RND) MOD 6+1)*16
GET (x(h), y(h))-(x(h)+20, y(h)+20), a
PUT (x(h), ym(h)), a: h=((h+1) MOD 9): IF h=0 THEN h=9
LOOP: FOR i=1 TO 9: Trr(i)=(ym(i)-175)/16: NEXT
ofn$=LTRIM$(STR$(ist))+"race.1"
OPEN ofn$ FOR OUTPUT AS #1: FOR i=1 TO 9: PRINT
  #1, Trr(i): NEXT
CLOSE #1: FOR i=1 TO 5: LOCATE i+5, 1: PRINT blank$:
  NEXT: LOCATE 10, 3
PRINT "Please WAIT for Odds Processing....": CALL Exdb
  (2, ist): RUN "Racing1"
File Racing1
DEFINT A-Z: DEFSNG A, P, R-T, W: OPTION BASE 1
DECLARE SUB calc1R1 ( ) : DECLARE SUB calc2P ( )
DECLARE SUB calc3M (r AS INTEGER, t AS INTEGER)
DECLARE SUB calc3N (r AS INTEGER, t AS INTEGER)
DECLARE SUB calc3O (r AS INTEGER, t AS INTEGER)
DECLARE SUB calc4IJ (r AS INTEGER, t AS INTEGER)
DECLARE SUB calc5XM (r AS INTEGER)
DECLARE SUB calc6IJK (r AS INTEGER, t AS
  INTEGER, i AS INTEGER)
DECLARE SUB calc7TM (r AS INTEGER, t AS
  INTEGER, i AS INTEGER)
DECLARE SUB Exdb (r AS INTEGER, t AS INTEGER)
DECLARE SUB calcPick1 (r AS INTEGER): DECLARE
  SUB calcPick1or2 (r AS INTEGER)
DECLARE SUB calcPick1or2or3 (r AS INTEGER)
DECLARE SUB calcPick2 (r AS INTEGER): DECLARE
  SUB calcPick3 (r AS INTEGER)
nR=7: mR=42: nP=7: mP=20: iA=9: nA=7
DIM SHARED Wt, Tr(iA), Trr(iA), R1(nR, mR), P(nP, mP),
  AM(nA, iA), AN(nA, iA), AO(nA, iA)
DIM SHARED WM(iA), WN(iA), WO(iA), PM(iA),
  SM(iA), WMN(iA, iA), WMNO(iA, iA, iA)
DIM SHARED AIJ(nA, nA, iA, iA), AXM(iA, iA), AIJK
  (nA, nA, iA, iA), ATM(iA, iA, iA), ist, ir
Tr(1)=14: Tr(2)=14: Tr(3)=14: Tr(4)=15: Tr(5)=15
Tr(6)=15: Tr(7)=16: Tr(8)=16: Tr(9)=16: Wt=1
DIM a(70), rc%(10), hn(10), x(10), y(10), ym(10), horse
  (10), n(6)
OPEN "race" FOR INPUT AS #1: INPUT #1, ist: CLOSE
  #1
RANDOMIZE TIMER: Esc$=CHR$(27): blank$=SPACE$
  (80)
SCREEN 12: first=0: r%=RND*9: kolor(1)=14: kolor(2)=
  15: kolor (3)=6
COLOR 10: LOCATE 2,29: PRINT "N I N E D I C E"
COLOR 10: LOCATE 4, 34: PRINT "Race"+LTRIM$
  (STR$(ist))
LOCATE 7, 6: PRINT "B E T": LOCATE 7, 18: PRINT "R
  U N" 'S
LOCATE 7, 51: PRINT "WPS/Exacta": LOCATE 7, 66:
  PRINT "WPS/Double" 'S
COLOR 8: LINE (38, 92)-(82, 112), 4, B: LINE (133,
  92)-(177, 112), 4, B
```

```
COLOR 8: LINE (388, 92)-(488, 112), 4, B: LINE (508,
  92)-(608, 112), 4, B
COLOR 10: win%=500: win=1: first=1: FOR i=11 TO 29:
  LOCATE i, 1
PRINT blank$;: NEXT: COLOR 2: LOCATE 12, 28:
  PRINT "F I N I S H";
LOCATE 28, 12: PRINT "S T A R T";
FOR i=0 TO 17: LINE (20, 175+i*16)-(620, 175+i*16), 2
IF i>0 AND i<16 THEN
IF i<14 THEN LOCATE 12+i, 12: PRINT i;
IF i<15 THEN LOCATE 12+i, 35: PRINT i;
LOCATE 12+i, 60: PRINT i;
END IF: IF i<4 THEN LINE (20+i*200, 192)-(20+i*200,
  432), 2
NEXT: LOCATE 26,4: PRINT " "
LOCATE 27, 4: PRINT " ";
FOR i=1 TO 9: i3=INT(i/3.1): hn(i)=i: horse(i)=0
rc%(i)=(r%+i) MOD 16: x(i)=64*i-7: y(i)=399+i3*16:
  ym(i)=y(i)
IF rc%(i)=0 THEN rc%(i)=10: IF rc%(i)=8 THEN rc%(i)=
  15
COLOR rc%(i): LOCATE 26+i3, i*8: PRINT i;
CIRCLE (x(i)+10, y(i)+8), 10, rc%(i),,, .8: NEXT: LOCATE
  10, 3
PRINT "Betting (b), Racing (r), Display WPS/Exacta (e),
  Display WPS/Double (d)" 'K
ifn$=LTRIM$(STR$(ist))+"race.1": OPEN ifn$ FOR
  INPUT AS #1
FOR i=1 TO 9: INPUT #1, Trr(i): NEXT: CLOSE #1: h=ist:
  counter=0
DO WHILE counter<9: counter=counter+1: FOR i=1 TO
  99: NEXT
ym(h)=Trr(h)*16+175: GET (x(h), y(h))-(x(h)+20, y(h)+
  20), a
PUT(x(h), ym(h)), a: h=((h+1) MOD 9): IF h=0 THEN h=9
LOOP: DO: a$=INKEY$: LOOP WHILE a$="": IF a$="b"
  THEN RUN "betting"
IF a$="e" THEN RUN "exscrn"
IF a$="d" THEN RUN "dbscrn"
FOR i=1 TO 5: LOCATE 5+i, 1: PRINT blank$: NEXT:
  h=ist: counter=0
DO WHILE counter<9: counter=counter+1: FOR i=1 TO
  9999: NEXT
ym(h)=ym(h)-(INT(1000000*RND) MOD 6+1)*16
GET (x(h), y(h))-(x(h)+20, y(h)+20), a
PUT (x(h), ym(h)), a: h=((h+1) MOD 9): IF h=0 THEN h=9
LOOP: FOR i=1 TO 9: Trr(i)=(ym(i)-175)/16: NEXT:
  ofn$=LTRIM$(STR$(ist))+"race.2"
OPEN ofn$ FOR OUTPUT AS #1: FOR i=1 TO 9: PRINT
  #1, Trr(i): NEXT
CLOSE #1: FOR i=1 TO 5: LOCATE i+5, 1: PRINT blank$:
  NEXT: LOCATE 10, 3
PRINT "Please WAIT for Odds Processing....": CALL Exdb
  (1, ist): RUN "racing2"
File Racing2
DIM a(70), rc%(10), hn(10), x(10), y(10), ym(10), horse
  (10), n(6)
OPEN "race" FOR INPUT AS #1: INPUT #1, ist: CLOSE
  #1
RANDOMIZE TIMER: Esc$=CHR$(27): blank$=SPACE$
  (80)
kolor(1)=14: kolor(2)=15: kolor(3)=6: SCREEN 12: first=0:
  r%=RND*9
kolor(1)=14: kolor(2)=15: kolor(3)=6
COLOR 10: LOCATE 2, 29: PRINT "N I N E D I C E"
COLOR 10: LOCATE 4, 34: PRINT "Race"+LTRIM$
  (STR$(ist))
LOCATE 7, 6: PRINT "B E T": LOCATE 7, 18: PRINT "R
  U N" 'S
LOCATE 7, 51: PRINT "WPS/Exacta": LOCATE 7, 66:
  PRINT "WPS/Double" 'S
COLOR 8: LINE (38, 92)-(82, 112), 4, B: LINE (133,
  92)-(177, 112), 4, B
LINE (388, 92)-(488, 112), 4, B: LINE (508, 92)-(608, 112),
  4, B: LOCATE 10, 3
PRINT "Betting (b), Racing (r), Display WPS/Exacta (e),
  Display WPS/Double (d)" 'K
COLOR 10: win%=500: win=1: first=1: FOR i=11 TO 29:
  LOCATE i, 1
PRINT blank$;: NEXT: COLOR 2: LOCATE 12, 28:
  PRINT "F I N I S H";
LOCATE 28, 12: PRINT "S T A R T";
FOR i=0 TO 17: LINE (20, 175+i*16)-(620, 175+i*16), 2
IF i>0 AND i<16 THEN
IF i<14 THEN LOCATE 12+i, 12: PRINT i;
IF i<15 THEN LOCATE 12+i, 35: PRINT I;: LOCATE
  12+i, 60: PRINT i;
END IF: IF i<4 THEN LINE (20+i*200, 192)-(20+i*200,
  432), 2
NEXT: LOCATE 26,4: PRINT" "
LOCATE 27, 4: PRINT" "
FOR i=1 TO 9: i3=INT(i/3.1): hn(i)=i: horse(i)=0
rc%(i)=(r%+i) MOD 16: x(i)=64*i-7: y(i)=399+i3*16:
  ym(i)=y(i)
IF rc%(i)=0 THEN rc%(i)=10: IF rc%(i)=8 THEN rc%(i)=
  15
COLOR rc%(i): LOCATE 26+i3, i*8: PRINT I;: CIRCLE
  (x(i)+10, y(i)+8), 10, rc%(i),,,,8: NEXT
ifn$=LTRIM$(STR$(ist))+"race.1": OPEN ifn$ FOR
  INPUT AS #1
FOR i=1 TO 9: INPUT #1, Trr(i): NEXT: CLOSE #1: h=ist:
  counter=0
DO WHILE counter<9: counter=counter+1: FOR i=1 TO
  99: NEXT
ym(h)=Trr(h)*16+175: GET (x(h), y(h))-(x(h)+20, y(h)+
  20), a
PUT (x(h), ym(h)), a: h=((h+1) MOD 9): IF h=0 THEN h=9
LOOP: ifn$=LTRIM$(STR$(ist))+"race.2"
OPEN ifn$ FOR INPUT AS #1: FOR i=1 TO 9: INPUT #1,
  Trr(i): NEXT: CLOSE #1: h=ist
counter=0: DO WHILE counter<9: counter=counter+1:
  FOR i=1 TO 99: NEXT
ym(h)=Trr(h)*16+175: GET (x(h), y(h))-(x(h)+20, y(h)+
  20), a
PUT (x(h), ym(h)), a: h=((h+1) MOD 9): IF h=0 THEN h=9
LOOP
DO: a$=INKEY$: LOOP WHILE as$="": IF a$="b" THEN
  RUN "betting"
IF a$="e" THEN RUN "exscrn"
IF a$="d"THEN RUN "dbscrn"
DO WHILE win<4: h=ist: counter=0: FOR i=1 TO 5:
  LOCATE i+5, 1: PRINT blank$: NEXT
DO WHILE counter<9: counter=counter+1: FOR i=1 TO
  999: NEXT
ym(h)=ym(h)-(INT(1000000*RND) MOD 6+1)*16: GET
  (x(h), y(h))-(x(h)+20, y(h)+20), a
IF horse(1)<>h AND horse(2)<>h THEN
IF ym(h)>175 THEN
PUT (x(h), ym(h)), a
ELSE PUT (x(h), 175), a: horse(win)=h
win%=500: COLOR kolor(win): LOCATE 11, INT(x(h)/8)
  +1: PRINT win;
LOCATE ist, 63+win*2: PRINT h;: win=win+1
IF win=4 THEN
```

```
ofn$="race"+LTRIM$(STR$(ist)): OPEN ofn$ FOR OUT-
  PUT AS #1
FOR i=1 TO 3: PRINT #1, horse(i): NEXT
END IF: CLOSE #1: IF win>=4 THEN EXIT DO
END IF
END IF: h=((h+1) MOD 9): IF h=0 THEN h=9
LOOP
IF win<4 THEN
COLOR 8: LINE (133, 92)-(177, 112), 4, B
LOCATE 7, 18: PRINT "R U N"
LOCATE 10, 3: COLOR (first+2): PRINT "Press any key to
  continue Race"
ELSE: FOR i=1 TO 3: LOCATE 5+i, 1: PRINT blank$:
  NEXT
LOCATE 7, 30: PRINT "Official Results": COLOR 8: LINE
  (228, 92)-(362, 112), 4, B
LOCATE 10, 3: COLOR (first+2): PRINT "Press any key
  for Official Results" 'K
END IF: DO: a$=INKEY$: LOOP WHILE a$="": LOOP:
  RUN "result"
File REGULA
DEFINT A-Z: DEFSNG A, P, R-T, W: OPTION BASE 1
DECLARE SUB calc1R1 ( ): DECLARE SUB calc2P ( )
DECLARE SUB calc3M (r AS INTEGER, t AS INTEGER)
DECLARE SUB calc3N (r AS INTEGER, t AS INTEGER)
DECLARE SUB calc3O (r AS INTEGER, t AS INTEGER)
DECLARE SUB calc4IJ (r AS INTEGER, t AS INTEGER)
DECLARE SUB calc5XM (r AS INTEGER)
DECLARE SUB calc6IJK (r AS INTEGER, t AS
  INTEGER, i AS INTEGER)
DECLARE SUB calc7TM (r AS INTEGER, t AS
  INTEGER, i AS INTEGER)
DECLARE SUB calc8DB (r AS INTEGER, t AS
  INTEGER)
DECLARE SUB calcPick1 (r AS INTEGER): DECLARE
  SUB calcPick1or2 (r AS INTEGER)
DECLARE SUB calcPick1or2or3 (r AS INTEGER)
DECLARE SUB calcPick2 (r AS INTEGER): DECLARE
  SUB calcPick3 (r AS INTEGER)
DECLARE SUB Exdb (r AS INTEGER, t AS INTEGER)
nR=7: mR=42: nP=7: mP=20: iA=9: nA=7
DIM SHARED Wt, Tr(iA), Trr(iA), R1(nR, mR), P(nP, mP),
  AM(nA, iA), AN(nA, iA), AO(nA, iA)
DIM SHARED WM(iA), WN(iA), WO(iA), WMN(iA, iA),
  WMNO(iA, iA, iA), PM(iA), SM(iA)
DIM SHARED AIJ(nA, nA, iA, iA), AXM(iA, iA), AIJK
  (nA, nA, iA, iA), ATM(iA, iA, iA), ist, ir
Tr(1)=14: Tr(2)=14: Tr(3)=14: Tr(4)=15: Tr(5)=15: Tr(6)=
  15: Tr(7)=16: Tr(8)=16
Tr(9)=16: Wt=1: ir=3: FOR i=1 to 9 Trr(i)=Tr(i): NEXT
CALL calc1R1: CALL calc2P: FOR ist=1 TO 9: CALL
  Exdb(ir, ist): NEXT: END
File Result
CLS: OPEN "race" FOR INPUT AS #1: INPUT #1, ist:
  CLOSE #1
INPUT "enter 1st place finisher#", p(0) 'N
INPUT "enter 2nd place finisher#", p(1) 'N
INPUT "enter 3rd place finisher#", p(2) 'N
OPEN "race"+LTRIM$(STR$(ist)) FOR INPUT AS #1 'A
FOR i=0 TO 2: INPUT #1, p(i): NEXT: CLOSE #1: 'A
LOCATE 1, 26: PRINT "Official Results $1 Payoffs"
LOCATE 2, 37: PRINT "Race"+LTRIM$(STR$(ist))
IF ist>2 THEN
OPEN "race"+LTRIM$(STR$(ist-2)) FOR INPUT AS #1:
  INPUT #1, ppp: CLOSE #1
END IF
IF ist>1 THEN
OPEN "race"+LTRIM$(STR$(ist-1)) FOR INPUT AS #1:
  INPUT #1, pp: CLOSE #1
END IF: LOCATE 4, 34: PRINT "Regular Bets": LOCATE
  11, 33: PRINT "Second Chance"
LOCATE 18, 34: PRINT "Last Chance": FOR h=0 TO 2:
  LOCATE 6+7 *h, 9:
PRINT "Win Place Show": LOCATE 7+7*h, 4: PRINT
  LTRIM$(STR$(p(0)))
ifn$=LTRIM$(STR$(ist))+"WIN."+LTRIM$(STR$(h)
OPEN ifn$ FOR INPUT AS #1: FOR i=1 TO 9: INPUT #1,
  pay
IF i=p(0) THEN LOCATE 7+7*h, 6: PRINT USING
  "###.##"; pay
NEXT: CLOSE #1: ifn$=LTRIM$(STR$(ist))+"PLACE."+
  LTRIM$(STR$(h))
OPEN ifn$ FOR INPUT AS #1: FOR i=1 TO 9: INPUT #1,
  pay
IF i=p(0) THEN LOCATE 7+7*h, 16: PRINT USING
  "###.##"; pay
NEXT: CLOSE #1: ifn$=LTRIM$(STR$(ist))+"SHOW."+
  LTRIM$(STR$(h))
OPEN ifn$ FOR INPUT AS #1: FOR i=1 TO 9: INPUT #1,
  pay
IF i=p(0) THEN LOCATE 7+7*h, 25: PRINT USING
  "###.##"; pay
NEXT: CLOSE #1: LOCATE 8+7*h, 4: PRINT LTRIM$
  (STR$(p(1)))
ifn$=LTRIM$(STR$(ist))+"PLACE."+LTRIM$(STR$(h))
OPEN ifn$ FOR INPUT AS #1: FOR i=1 TO 9: INPUT #1,
  pay
IF i=p(1) THEN LOCATE 8+7*h, 16: PRINT USING
  "###.##"; pay:
NEXT: CLOSE #1: ifn$=LTRIM$(STR$(ist))+"SHOW."+
  LTRIM$(STR$(h))
OPEN ifn$ FOR INPUT AS #1: FOR i=1 TO 9: INPUT #1,
  pay
IF i=p(1) THEN LOCATE 8+7*h, 25: PRINT USING
  "###.##"; pay: NEXT: CLOSE #1
LOCATE 9+7*h, 4: PRINT LTRIM$(STR$(p(2)))
ifn$=LTRIM$(STR$(ist))+"SHOW."+LTRIM$(STR$(h))
OPEN ifn$ FOR INPUT AS #1: FOR i=1 TO 9: INPUT #1,
  pay
IF i=p(2) THEN LOCATE 9+7*h, 25: PRINT USING
  "###.##"; pay:
NEXT: CLOSE #1: NEXT: FOR h=0 TO 2: LOCATE
  6+7*h, 37: PRINT "Exacta"
LOCATE 7+7*h, 39: PRINT LTRIM$(STR$(p(0)))+"-"+
  LTRIM$(STR$(p(1)))
ifn$=LTRIM$(STR$(ist))+"Exacta."+LTRIM$(STR$(h))
OPEN ifn$ FOR INPUT AS #1: FOR i=1 TO 9: FOR j=1 TO
  9: INPUT #1, pay
IF i=p(0) ANDj=p(1) THEN: LOCATE 8+7*h, 36: PRINT
  USING "####.#"; pay
NEXT: NEXT: CLOSE #1: NEXT: IF pp<>0 AND ist>1
  THEN q=10 ELSE q=0
IF q=10 THEN
FOR h=0 TO 2: LOCATE 6+7*h, 47: PRINT "Double"
LOCATE 7+7*h, 49: PRINT LTRIM$(STR$(pp))+"-"+
  LTRIM$(STR$(p(0)))
ifn$=LTRIM$(STR$(ist-1))+"Double."+LTRIM$(STR$
  (h))
OPEN ifn$ FOR INPUT AS #1: FOR i=1 TO 9: FOR j=1 TO
  9: INPUT #1, pay
IF i=pp AND j=p(0) THEN LOCATE 8+7*h, 46: PRINT
  USING "####.#"; pay
NEXT: NEXT: CLOSE #1: NEXT
END IF: FOR h=0 TO 2: LOCATE 6+7*h, 57: PRINT
  "Tricta": LOCATE 7+7*h, 58
```

```
PRINT LTRIM$(STR$(p(0)))+"-"+LTRIM$(STR$(p(1)))+
  "-"+LTRIM$(STR$(p(2)))
ifn$=LTRIM$(STR$(ist))+"Tricta."+LTRIM$(STR$(h))
OPEN ifn$ FOR INPUT AS #1: FOR i=1 TO 9: FOR j=1 TO
  9: FOR k=1 TO 9: INPUT #1, pay
IF i=p(0) AND j=p(1) AND k=p(2) THEN
LOCATE 8+7*h, 57: PRINT USING "####.#"; pay
END IF: NEXT: NEXT: NEXT: CLOSE #1: NEXT
IF pp<>0 AND ppp<>0 AND ist>1 THEN qq=10 ELSE
  qq=0
IF qq=10 THEN
FOR h=0 TO 2: LOCATE 6+7*h, 67: PRINT "Triple":
  LOCATE 7+7*h, 68
PRINT LTRIM$(STR$(ppp))+"-"+LTRIM$(STR$(pp))+
  "-"+LTRIM$(STR$(p(0)))
ifn$=LTRIM$(STR$(ist-2))+"Triple."+LTRIM$(STR$(h))
OPEN ifn$ FOR INPUT AS #1: FOR i=1 TO 9: FOR j=1 TO
  9: FOR k=1 TO 9: INPUT #1, pay
IF i=ppp AND j=pp AND k=p(0) THEN LOCATE 8+7*h,
  67: PRINT USING "####.#"; pay
NEXT: NEXT: NEXT: CLOSE #1: NEXT
END IF: LOCATE 24, 1
PRINT "REMINDER: Play the subsequent race OR pending
  bets will be cancelled/refunded" 'A
FOR i=1 TO 19999: NEXT: RUN "screen0" 'A
File Screen0
SCREEN 12: FOR i=0 TO 2: FOR j=0 TO 2:LOCATE
  8+5*i, 21+16*j
PRINT "Race"; 1+3*i+j: NEXT: NEXT 'S
FOR i=1 TO 3: FOR j=1 TO 3
LINE (20+i*130, 20+j*80)-(80+i*130, 60+j*80), 11, B:
  NEXT: NEXT
LOCATE 23, 20: PRINT "1. Insert cash voucher or winning
  ticket"
LOCATE 24, 20: PRINT "2. Pick a race"
LOCATE 26, 18: PRINT "Enter race number 1-9" 'K
DO: a$=INKEY$: LOOP WHILE a$=""
If a$<>0 then OPEN "race" FOR OUTPUT AS #1: PRINT
  #1, a$, 3: CLOSE #1: RUN "racing0"
SUB calc1R1
FOR m=1 TO 6: R1(1, m)=1: NEXT: FOR m=2 TO 7: R1(2,
  m)=m-1: NEXT
FOR m=8 TO 12:R1(2,m)=13-m: NEXT: FOR n=3 TO 7:
  FOR m=n TO 6*n
IF m-7<1 THEN RD=0 ELSE RD=R1(n-1, m-7)
R1(n, m)=-RD+R1(n, m-1)+R1((n-1), (m-1)): NEXT:
  NEXT: END SUB SUB calc2P
FOR m=1 TO 6: P(1, m)=(7-m)/6: NEXT m: FOR n=2 TO
  7: FOR i=1 TO 18: PNUM=0
FOR j=1 TO 6: IF n-1>j-7+i THEN RD=0 ELSE RD=R1
  (n-1, j-7+i)
PNUM=PNUM+RD*j: NEXT: PDEN=0
FOR k=n-1 TO i-1: PDEN=PDEN+R1((n-1), k): NEXT
IF n>i THEN P(n, i)=0 ELSE P(n, i)=PNUM/(6*PDEN)
NEXT: NEXT: END SUB
SUB calc3M (r AS INTEGER, t AS INTEGER)
ACCUM=0: FOR n=r TO r+4: FOR i=t TO 9
AM(n, i)=P(n, Trr(i))*(1-ACCUM): ACCUM=ACCUM+
  AM(n, i): NEXT: FOR i=1 TO t-1
AM(n, i)=P(n, Trr(i))*(1-ACCUM): ACCUM=ACCUM+
  AM(n, I): NEXT: NEXT: END SUB
SUB calc3N (r AS INTEGER, t AS INTEGER)
ACCUM=0: FOR n=r TO r+4: FOR i=t+1 TO 9
AN(n, i)=P(n, Tr(i))*(1-ACCUM): ACCUM=ACCUM+
  AN(n, i): NEXT: FOR i=1 TO t
AN(n, i)=P(n, Tr(i))*(1-ACCUM): ACCUM=ACCUM+
  AN(n, i): NEXT: NEXT: END SUB
SUB calc3O (r AS INTEGER, t AS INTEGER)
ACCUM=0: FOR n=r TO r+4
IF t<>9 THEN
FOR i=t+2 TO 9: AO(n, i)=P(n, Tr(i))*(1-ACCUM):
  ACCUM=ACCUM+AO(n, i): NEXT
FOR i=1 TO t+1: AO(n, i)=P(n, Tr(i))*(1-ACCUM):
  ACCUM=ACCUM+AO(n, i): NEXT
ELSE FOR i=2 TO 9: AO(n, i)=P(n, Tr(i))*(1-ACCUM):
  ACCUM=ACCUM+AO(n, i): NEXT
FOR i=1 TO 1: AO(n, i)=P(n, Tr(i))*(1-ACCUM):
  ACCUM=ACCUM+AO(n, i): NEXT
END IF: NEXT: END SUB
SUB calc4IJ (r AS INTEGER, t AS INTEGER)
FOR g=r TO r+4: FOR i=1 TO 9: ACCUM=0:FOR n=g TO
  r+4: FOR j=t TO 9
IF j=i THEN
AIJ(g,n,i,j)=0
ELSEIF n=g AND i<t THEN AIJ(g, n, i, j)=0
ELSEIF n=g AND j<i AND t<i THEN AIJ(g, n, i, j)=0
ELSE AIJ(g, n, i, j)=P(n, Tr(j))*(1-ACCUM): ACCUM=
  ACCUM+AIJ(g, n, i, j)
END IF: NEXT: FOR j=1 TO t-1
IF j=i THEN
AIJ(g, n, i, j)=0
ELSEIF n=g AND j<i AND i<t THEN AIJ(g, n, i, j)=0
ELSE AIJ(g, n, i, j)=P(n, Tr (j))*(1-ACCUM): CCUM=
  ACCUM+AIJ(g, n, i, j)
END IF: NEXT: NEXT: NEXT: NEXT: END SUB
SUB calc5XM (r AS INTEGER)
FOR i=1 TO 9: FOR j=1 TO 9: FOR g=r TO r+4:
  ACCUM=0
FOR n=g TO r+4: ACCUM=ACCUM+AIJ(g, n, i, j): NEXT
AXM(i, j)=AXM(i, j)+ACCUM*AM(g, i): NEXT: NEXT:
  NEXT: END SUB
SUB calc6IJK (r AS INTEGER, t AS INTEGER, i AS
  INTEGER)
FOR g=r TO r+4: FOR j=1 TO 9: ACCUM=0: FOR n=g TO
  r+4: FOR k=t TO 9
IF j=i OR k=j OR k=i THEN
AIJK(g, n, j, k)=0
ELSEIF n=g AND t<i AND i<j AND k<j THEN AIJK
  (g,n,j,k)=0
ELSEIF n=g AND j<t AND t<i THEN AIJK(g, n, j, k)=0
ELSEIF n=g AND j=t THEN AIJK(g, n, j, k)=0
ELSEIF n=g AND t<j AND j<i THEN AIJK(g, n, j, k)=0
ELSEIF n=g+1 AND t<j AND j<i AND k<j THEN AIJK(g,
  n, j, k)=0
ELSEIF n=g AND i<j AND j<t THEN AIJK(g, n, j, k)=0
ELSEIF n=g AND i<t AND t<j THEN AIJK(g, n, j, k)=0
ELSEIF n=g+1 AND i<t AND t<j AND k<j THEN AIJK(g,
  n, j, k)=0
ELSEIF n=g AND j<i AND i<t THEN AIJK(g, n, j, k)=0
ELSEIF n=g+1 ANDj<i AND i<t THEN AIJK(g,n,j,k)=0
ELSE AIJK(g, n, j, k)=P(n, Tr(k))*(1-ACCUM): ACCUM=
  ACCUM+AIJK(g, n, j, k)
END IF: NEXT: FOR k=1 TO t-1
IF j=i OR k=j OR k=i THEN
AIJK(g, n, j, k)=0
ELSEIF n=g AND j<t AND t<i AND k<j THEN AIJK(g, n,
  j, k)=0
ELSEIF n=g AND j=t THEN AIJK(g, n, j, k)=0
ELSEIF n=g AND t<j AND j<i THEN AIJK(g, n, j, k)=0
ELSEIF n=g AND i<j AND j<t AND k<j THEN AIJK(g, n,
  j, k)=0
ELSEIF n=g AND i<t AND t<j THEN AIJK(g, n, j, k)=0
ELSEIF n=g AND j<i AND i<t THEN AIJK(g, n, j, k)=0
ELSEIF n=g+1 AND j<i AND i<t AND k<j THEN AIJK(g,
  n, j, k)=0
```

```
ELSE AIJK(g, n, j, k)=P(n, Tr(k))*(1-ACCUM): ACCUM=
  ACCUM+AIJK(g, n, j, k)
END IF: NEXT: NEXT: NEXT: NEXT: END SUB
SUB calc7TM (r AS INTEGER, t AS INTEGER, i AS
  INTEGER)
CALL calc6IJK(r, t, I): FOR j=1 TO 9: FOR k=1 TO 9
IF i=j OR j=k OR i=k THEN
ATM(i, j, k)=0:
ELSE: FOR iu=r TO r+4: AS2=0: FOR it=iu TO r+4: AS1=0
FOR iss=it TO r+4: AS1=AS1+AIJK(it, iss, j, k): NEXT
AS2=AS2+AS1*AIJ(iu, it, i, j): NEXT: ATM(i, j, k)=ATM
  (i, j, k)+AM(iu, i)*AS2: NEXT
END IF: NEXT: NEXT: END SUB
SUB calcPick1 (r AS INTEGER)
FOR i=1 TO 9: WM(i)=0
FOR n=r TO r+4: WM(i)=WM(i)+AM(n, i): NEXT: NEXT:
  END SUB
SUB calcPick1or2 (r AS INTEGER)
FOR i=1 TO 9: PM(i)=WM(i)
FOR j=1 TO 9: PM(i)=PM(i)+AXM(j, i): NEXT: NEXT:
  END SUB
SUB calcPick1or2or3 (r AS INTEGER)
FOR k=1 TO 9: SM(k)=PM(k): FOR i=1 TO 9: FOR j=1 TO
  9
SM(k)=SM(k)+ATM(i, j, k): NEXT: NEXT: NEXT: END
  SUB
SUB calcPick2 (r AS INTEGER)
FOR i=1 TO 9: WM(i)=0: FOR n=r TO r+4: WM(i)=WM
  (i)+AM(n, i): NEXT: NEXT
FOR i=1 TO 9: WN(i)=0: FOR n=r TO r+4: WN(i)=WN(i)
  +AN(n, i): NEXT: NEXT
FOR i=1 TO 9: FOR j=1 TO 9: WMN(i, j)=WM(i)*WN(j):
  NEXT: NEXT: END SUB
SUB calcPick3 (r AS INTEGER)
FOR i=1 TO 9: WM(i)=0: FOR n=r TO r+4: WM(i)=WM
  (i)+AM(n, i): NEXT: NEXT
FOR i=1 TO 9: WN(i)=0: FOR n=r TO r+4: WN(i)=WN(i)
  +AN(n, i): NEXT: NEXT
FOR i=1 TO 9: WO(i)=0: FOR n-r TO r+4: WO(i)=WO(i)
  +AO(n, i): NEXT: NEXT
FOR i=1 TO 9: FOR j=1 TO 9 : FOR k=1 TO 9
WMNO(i, j, k)=WM(i)*WN(j)*WO(k): NEXT: NEXT:
  NEXT: END SUB
SUB display5XM (t AS INTEGER)
PRINT "Exacta, Race"+LTRIM$(STR$(t)): PRINT "i";
FOR n=1 TO 9: PRINT "EX"+"("+"i,"+LTRIM$(STR$(n)
  )+")";: NEXT
PRINT: FOR i=1 TO 9: PRINT STR$(i)+" ";: FOR n=1 TO
  9:
IF n=i THEN PRINT "------"; ELSE PRINT USING
  ".######"; AXM(i, n);: NEXT: PRINT: NEXT
SUM=0: FOR i=1 TO 9: FOR j=1 TO 9: SUM=SUM+AXM
  (i, j): NEXT: NEXT
PRINT "Summation of all Exactas=AXM(i,j) is "; USING
  ".######"; SUM: PRINT: END SUB
SUB display7TM (t AS INTEGER, i AS INTEGER)
i=1: DO WHILE (i>=1 AND 10>I): INPUT "Display any
  Tricta Probabilities? For Winner #", i
IF (i=0) THEN EXIT DO
PRINT "Tricta, Race"+LTRIM$(STR$(t))+"Winner"+
  LTRIM$(STR$(i)): PRINT "j";
FOR k=1 TO 9: PRINT "("+LTRIM$(STR$(i))+","+"j,"+
  LTRIM$(STR$(k))+")";:NEXT
PRINT: FOR j=1 TO 9: PRINT STR$(j)+" ";: FOR k=1 TO
  9
IF j=k OR i=j OR i=k THEN PRINT"------"; ELSE PRINT
  USING ".######"; ATM(i, j, k);
NEXT: PRINT: NEXT: PRINT: LOOP: PRINT: END SUB
SUB displayPick1 (t AS INTEGER)
PRINT "Win, Race"+LTRIM$(STR$(t)): PRINT " ";
FOR n=1 TO 9: PRINT "Win"+"("+LTRIM$(STR$(n))+")
  ";:NEXT: PRINT
PRINT " ";: FOR i=1 TO 9: PRINT USING ".######";
  WM(i);: NEXT: PRINT
WS=0: FOR i=1 TO 9: WS=WS+WM(i): NEXT
PRINT "Summation of all Wins"+"for i=1 to 9 s "; USING
  ".######"; WS: PRINT: END SUB
SUB displayPick1or2 (t AS INTEGER)
PRINT "Place, Race"+LTRIM$(STR$(t)): PRINT " ";
FOR n=1 TO 9: PRINT "PL"+"("+LTRIM$(STR$(n))+")";:
  NEXT: PRINT
PRINT " ";: FOR n=1 TO 9: PRINT USING ".######";
  PM(n);: NEXT: PRINT
PS=0: FOR i=1 TO 9: PS=PS+PM(i): NEXT
PRINT "Summation of all Places"+"for i=1 to 9 is "; USING
  ".######"; PS: PRINT: END SUB
SUB displayPick1or2or3 (t AS INTEGER)
PRINT"Show, Race"+LTRIM$(STR$(t)): PRINT " ";
FOR=1 TO 9: PRINT "SH"+"("+LTRIM$(STR$(n))+")";:
  NEXT: PRINT
PRINT " ";: FOR n=1 TO 9: PRINT USING ".######";
  SM(n);: NEXT: PRINT
SS=0: FOR i=1 TO 9: SS=SS+SM(i): NEXT
PRINT "Summation of all Shows"+"for i=1 to 9 is ";
  USING".######"; SS: PRINT: END SUB
SUB displayPick2 (t AS INTEGER)
PRINT "Double, Race "+LTRIM$(STR$(t)): PRINT "i
  ";:FOR j=1 TO 9
PRINT CHR$(64+t)+"(i,"+LTRIM$(STR$(j))+")";: NEXT:
  PRINT: FOR i=1 TO 9:
PRINT USING "##"; I;: FOR j=1 TO 9: PRINT USING
  ".######"; WMN(i, j);: NEXT: PRINT:
NEXT: SUM=0: FOR i=1 TO 9: FOR j=1 TO 9: SUM=
  SUM+WMN(i, j): NEXT: NEXT
PRINT "Summation of all Doubles is "; USING
  ".#######"; SUM: PRINT: END SUB
SUB displayPick3 (t AS INTEGER)
i=1: DO WHILE (i>=1 AND 10>i)
INPUT "Display any Triples Probabilities? For this Race
  Winner #", i
IF (i=0) THEN EXIT DO
PRINT "Triples, Race"+LTRIM$(STR$(t)): PRINT "j";:
  FOR k=1 TO 9
PRINT "("+LTRIM$(STR$(i))+","+"j,"+LTRIM$(STR$(k)
  )+")";: NEXT: PRINT
FOR j=1 TO 9: PRINT STR$(j)+" ";: FOR k=1 TO 9:
  PRINT USING ".######"; WMNO(i, j, k);
NEXT: PRINT: NEXT: PRINT: LOOP: PRINT: END SUB
SUB Exdb (ir AS INTEGER, ist AS INTEGER)
FOR i=1 TO 9: WM(i)=0: WN(i)=0: WO(i)=0: PM(i)=0:
  SM(i)=0: NEXT
FOR i=1 TO 7: FOR j=1 TO 9: AM(i, j)=0: AN(i, j)=0: AO(i,
  j)=0: NEXT: NEXT
FOR i=1 TO 9: FOR j=1 TO 9: WMN(i, j)=0: AXM(i, j)=0:
  NEXT: NEXT
FOR i=1 TO 9: FOR j=1 TO 9: FOR k=1 TO 9
WMNO(i, j, k)=0: ATM(i, j, k)=0: NEXT: NEXT: NEXT
FOR i=1 TO 7: FOR j=1 TO 7: FOR k=1 TO 9: FOR 1=1
  TO 9
AIJ(i, j, k, 1)=0: AIJK(i, j, k, 1)=0: NEXT: NEXT: NEXT:
  NEXT
CLS: title$="NINE DICE $1 (ONE DOLLAR) PAYOFFS"
  'R
LOCATE 1, (80-LEN(title$))/2: PRINT title$ 'R
```

```
LOCATE 2, 28: PRINT "RACE"+LTRIM$(STR$(ist)) 'R
LOCATE 2, 40: IF ir=3 THEN PRINT "Regular Bets" 'R
IF ir=2 THEN PRINT "Second Chance" 'R
IF ir=1 THEN PRINT "Last Chance" 'R
LOCATE 4, 1: PRINT "Racer#": FOR i=1 TO 9: LOCATE
  4,9+(i-1)*8: PRINT i: NEXT 'R
CALL calc3M(ir, ist): CALL calc3N(ir, ist): CALL calc3O
  (ir, ist)
CALL calcPick1(ir): CALL calcPick2(ir): CALL calcPick3
  (ir)
LOCATE 6, 1: PRINT "WIN": FOR i=1 TO 9: LOCATE 6,
  7+(i-1)*8: 'R
IF WM(i)=0 OR WM(i)<=0.001*Wt THEN PRINT
  "999.99": 'R
IF WM(i)>0.001*Wt THEN PRINT USING "###.##";
  Wt/WM(i) 'R
NEXT: ofn$=LTRIM$(STR$(ist))+"WIN"+"."+LTRIM$
  (STR$(3-ir))
OPEN ofn$ FOR OUTPUT AS #1: FOR i=1 TO 9:
IF WM(i)=0 OR WM(i)<=0.001*Wt THEN PRINT #1,
  "999.99"
IF WM(i)>0.001*Wt THEN PRINT #1, USING "###.##";
  Wt/WM(i)
NEXT: FOR i=1 TO 9: PRINT #1, " "; LTRIM$(STR$(Trr
  (i)));: NEXT: CLOSE #1
CALL calc4IJ(ir, ist): CALL calc5XM(ir): CALL
  calcPick1or2(ir)
LOCATE 8, 1: PRINT "PLACE": FOR i=1 TO 9: LOCATE
  8, 7+(i-1)*8: 'R
IF PM(i)=0 OR PM(i)<=0.001*Wt THEN PRINT "999.99":
  'R
IF PM(i)>0.001*Wt THEN PRINT USING "###.##";
  Wt/PM(i) 'R
NEXT: ofn$=LTRIM$(STR$(ist))+"PLACE"+"."+LTRIM$
  (STR$(3-ir))
OPEN ofn$ FOR OUTPUT AS #1: FOR i=1 TO 9:
IF PM(i)=0 OR PM(i)<=0.001*Wt THEN PRINT #1,
  "999.99"
IF PM(i)>0.001*Wt THEN PRINT #1, USING "###.##";
  Wt/PM(i): NEXT: CLOSE #1
title$="EXACTA": LOCATE 12, (80-LEN(title$))/2:
  PRINT title$: LOCATE 13, 1 'R
PRINT "Racer#": FOR i=1 TO 9: LOCATE 13, 10+(i-1)*8:
  PRINT "&"+LTRIM$(STR$(i)): 'R
NEXT: FOR i=1 TO 9: LOCATE i+13, 2: PRINT STR$(i)
  +"&" 'R
FOR j=1 TO 9: LOCATE i+13, 7+(j-1)*8: IF i=j THEN
  PRINT "-------" 'R
IF i<>j AND AXM(i, j)<=0.0001*Wt THEN PRINT
  "9999.9" 'R
IF i<>j AND AXM(i, j)>0.0001*Wt THEN PRINT USING
  "####.#"; Wt/AXM(i, j) 'R
NEXT: NEXT: NEXT: CLOSE #1 'R
ofn$=LTRIM$(STR$(ist))+"EXACTA"+"."+LTRIM$
  (STR$(3-ir))
OPEN ofn$ FOR OUTPUT AS #1: FOR i=1 TO 9: FOR j=1
  TO 9: IF i=j THEN PRINT #1, "0"
IF i<>j AND AXM(i, j)<=0.0001*Wt THEN PRINT #1,
  "9999.9"
IF i<>j AND AXM(i, j)>0.0001*Wt THEN PRINT #1,
  USING "###.##"; Wt/AXM(i, j)
NEXT: NEXT: FOR i=1 TO 9: PRINT #1, LTRIM$(STR$
  (Tr(i)));: NEXT: CLOSE #1
LOCATE 10, 1: PRINT "SHOW" 'R
LOCATE 23, 2: PRINT SPACE$(50)+"Proccessing Show
  Odds..." 'R
FOR i=1 TO 9: CALL calc7TM(ir, ist, i): NEXT
ofn$=LTRIM$(STR$(ist))+"TRICTA"+"."+LTRIM$(STR$
  (3-ir))
OPEN ofn$ FOR OUTPUT AS #1: FOR i=1 TO 9: FOR j=1
  TO 9: FOR k=1 TO 9
IF i=j OR i=k OR j=k THEN
PRINT #1, "0":
ELSEIF ATM(i, j, k)<=0.0001*Wt THEN PRINT #1,
  "9999.9"
ELSE PRINT #1, USING "####.#"; Wt/ATM(i, j, k)
END IF: NEXT: NEXT: NEXT: CLOSE #1: CALL
  calcPick1or2or3(ir)
FOR i=1 TO 9: LOCATE 10, 7+(i -1)*8: PRINT USING
  "###.##"; Wt/SM(i): NEXT 'R
ofn$=LTRIM$(STR$(ist))+"SHOW"+"."+LTRIM$(STR$
  (3-ir))
OPEN ofn$ FOR OUTPUT AS #1: FOR i=1 TO 9: PRINT
  #1, Wt/SM(i);: NEXT: CLOSE #1
LOCATE 23, 20: PRINT SPACE$(57) 'R
title$="DOUBLE": LOCATE 12, (80-LEN(title$))/2:
  PRINT title$ 'R
LOCATE 13, 1: PRINT "Racer#": FOR i=1 TO 9 'R
LOCATE 13, 10 +(i-1)*8: PRINT "&"+LTRIM$(STR$(i)):
  NEXT 'R
FOR i=1 TO 9: LOCATE i+13, 2: PRINT STR$(i)+"&" 'R
FOR j=1 TO 9: LOCATE i+13, 7+(j-1)*8 'R
IF WMN(i,j)<=0.0001*Wt THEN PRINT "9999.9" 'R
IF WMN(i, j)>0.0001*Wt THEN PRINT USING "####.#";
  Wt/WMN(i, j): 'R
NEXT: NEXT: ofn$=LTRIM$(STR$(ist))+"DOUBLE"+
  "."+LTRIM$(STR$(3-ir))
OPEN ofn$ FOR OUTPUT AS #1: FOR i=1 TO 9: FOR j=1
  TO 9
IF WMN(i, j)<=0.0001*Wt THEN PRINT #1, "9999.9"
IF WMN(i, j)>0.0001*Wt THEN PRINT #1, USING
  "####.#"; Wt/WMN(i, j)
NEXT: NEXT: CLOSE #1: ofn$=LTRIM$(STR$(ist))+
  "TRIPLE"+"."+LTRIM$(STR$(3-ir))
OPEN ofn$ FOR OUTPUT AS #1: FOR i=1 TO 9: FOR j=1
  TO 9: FOR k=1 TO 9
IF WMNO(i, j, k)<=0.0001*Wt THEN PRINT #1, "9999.9"
IF WMNO(i,j, k)>0.0001*Wt THEN PRINT #1, USING
  "####.#"; Wt/WMNO(i, j, k): NEXT
NEXT: NEXT: CLOSE #1: OPEN "race" FOR OUTPUT
  AS #1: PRINT #1, ist, ir: END SUB
SUB Pick3Check
SUM=0: FOR i=1 TO 9: FOR j=1 TO 9: FOR k=1 TO 9:
  SUM=SUM+WMNO(i, j, k): NEXT
NEXT: NEXT: PRINT "Summation of all Triples is";
  USING ".######"; SUM: END SUB
SUB TriCheck
SUM=0: FOR i=1 TO 9: FOR j=1 TO 9: FOR k=1 TO 9:
  SUM=SUM+ATM(i, j, k): NEXT
NEXT: NEXT:PRINT "Summation of all Trictas=ATM(i,j,
  k) is "; USING ".######"; SUM
PRINT: END SUB
```

CONCLUSION

The specification is extensive so that every reader can easily find exactly what he wants or needs.

Probability formulae are for those who interested in deriving probabilities based on the nature of a race.

File 91416 is for those who interested in using a computer to calculate all kinds of probabilities based on the probability formulae.

Files Regula, 2nd1st, Exscrn Dbscrn, Betting and Result must be included as computer programs in the non-automatic game. However, only the dealer has to know how to open a file and to enter data related to a race. Other players just enjoy watching information provided by these files.

Files Exscrn Dbscrn, Screen0, Betting, Racing0, Racing1, Racing2, Result and data files created by files Regula and Dummy must be included as computer programs in the automatic version. But players don't have to know anything about them.

Manufacturers of screen activated machines must pay attention to all computer program statements ended with 'S, 'B or 'RBD to ensure that the product will function properly.

To understand the non-automatic game one only needs to read the description of that version.

To understand the automatic game one only needs to read the description of that version.

While the embodiment shown and described is fully capable of achieving the objects and advantages of my invention, it will be clear to those skilled in the art that many variations can be made in this invention without departing from the inventive concepts herein disclosed and it is not the intention of the inventor to be limited by these specific embodiments shown and described.

For example, the number of racers doesn't have to be nine, the total numbers of advancement spaces are not necessary 14 to 16. The number of spaces to advance at each turn must not be 1 to 6. That is, varying parameters in the probability formulas and computer programs disclosed here can result in numerous variations of the game.

For example, racer markers can be moved by a motor driven operation instead of by hand.

For example, using lamps for racer markers such that there is one lamp on each advancement space and the position of a racer is shown by a lighting lamp.

For example, the dice box can be replaced by a chance devise or random number generator.

For example, any QBasic program can be translated into a language compatible with computers of systems or compilers other than DOS 5.0+.

For example, the screen activated machine can be replaced by a machine with push buttons.

For example, the mainframe computer with database wagering system, hand-held printers and screen activated self-service wagering machines can all be omitted if there are not many players or bets. Simply a personal computer with keyboard and monitor can handle both the non-automatic and the automatic game.

I claim:

1. A method of playing a betting race game comprising the steps of providing a plurality of racer on a race course, providing a plurality of payoff tables for the racers of a race in a plurality of finishing orders, permitting players to place bets on the racers of the race before and after the race has begun, determining a plurality of numbers, advancing the racers of the race on the race course according to said plurality of numbers, determining race results, providing official payoff results.

2. A device for playing a game using the steps of claim 1 wherein a dice box being used for said determining a plurality of numbers, said dice box comprising, a hollow cylinder of transparent material, a revolving partition structure, a metal weight and a plurality of dice, said hollow cylinder having a stud on each inside face of circular plate, said revolving partition structure comprising two horizontal plates of transparent material and two vertical strips and therein a plurality of horizontal and vertical bars to form a plurality of compartments each housing one said die, said vertical strips having each a hole to receive said stud so that said partition structure is pivotedly mounted on said studs, said weight being confined between said strips and the lower one of said horizontal plates.

3. A device for playing a game using the steps of claim 1 and further comprising means for displaying.

4. A device for playing a game using the steps of claim 1 and further comprising means for displaying that is screen activated.

* * * * *

UNITED STATES PATENT AND TRADEMARK OFFICE

CERTIFICATE OF CORRECTION

PATENT NO. : 5,795,226

DATED : August 18, 1998

INVENTOR(S) : Chen, Yi

It is certified that error appears in the above-identified patent and that said Letters Patent is hereby corrected as shown below:

On the title page, under item [19], delete "Yi" and insert --Chen--.

On the title page, item [76], "Chen Yi" should read --Yi Chen--.

Signed and Sealed this

Twenty-fourth Day of November, 1998

*Attest:*

Bruce Lehman

BRUCE LEHMAN

*Attesting Officer*

*Commissioner of Patents and Trademarks*